US010832627B2

(12) United States Patent
Cheng et al.

(10) Patent No.: US 10,832,627 B2
(45) Date of Patent: Nov. 10, 2020

(54) DISPLAY APPARATUS AND SOURCE DRIVER THEREOF AND OPERATING METHOD

(71) Applicant: Novatek Microelectronics Corp., Hsinchu (TW)

(72) Inventors: Jhih-Siou Cheng, New Taipei (TW); Yi-Chuan Liu, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 423 days.

(21) Appl. No.: 15/209,778

(22) Filed: Jul. 14, 2016

(65) Prior Publication Data

US 2018/0018928 A1 Jan. 18, 2018

(51) Int. Cl.
*G09G 3/36* (2006.01)
*G09G 3/20* (2006.01)

(52) U.S. Cl.
CPC ..... *G09G 3/3696* (2013.01); *G09G 3/2092* (2013.01); *G09G 3/3659* (2013.01); *G09G 3/3688* (2013.01); *G09G 2300/043* (2013.01); *G09G 2300/0828* (2013.01); *G09G 2310/027* (2013.01); *G09G 2310/0291* (2013.01);
(Continued)

(58) Field of Classification Search
CPC ..... G09G 3/3696; G09G 2310/0291; G09G 2320/0673; G09G 3/3688; G09G 3/3659; G09G 3/2092; G09G 2320/0247; G09G 2310/291; G09G 2310/0294;
(Continued)

(56) References Cited

U.S. PATENT DOCUMENTS 6,995,701 B1 * 2/2006 Churchill ..... H03M 1/682 341/110
8,525,764 B2 9/2013 Liou et al.
(Continued)

FOREIGN PATENT DOCUMENTS

CN 101004527 7/2007
CN 101847376 9/2010
(Continued)

OTHER PUBLICATIONS

"Office Action of Taiwan Counterpart Application", dated Feb. 18, 2017, p. 1-p. 5, in which the listed references were cited.
(Continued)

*Primary Examiner* — Dennis P Joseph
(74) *Attorney, Agent, or Firm* — JCIPRNET

(57) ABSTRACT

A display apparatus, a source driver of the display apparatus and an operating method of the source driver are provided. The display apparatus includes a display panel, at least one gate driver and a plurality of source drivers. The display panel includes a plurality of source lines and a plurality of gate lines. A plurality of output terminals of the gate driver are coupled to the gate lines in one-to-one manner. A plurality of output terminals of the source drivers are coupled to the source lines in one-to-one manner to provide a plurality of source driving voltages to the source lines. The source driving voltages include different coarse compensation voltages. The coarse compensation voltages are respectively configured based on distances between the source drivers which control the source lines and input terminals of the gate lines of the display panel.

22 Claims, 13 Drawing Sheets

(52) U.S. Cl.
CPC ..... *G09G 2320/0247* (2013.01); *G09G 2320/0673* (2013.01); *G09G 2330/028* (2013.01)

(58) Field of Classification Search
CPC ..... G09G 2300/0828; G09G 2330/028; G09G 2310/027
See application file for complete search history.

(56) References Cited

U.S. PATENT DOCUMENTS

| | | | | |
|---|---|---|---|---|
| 8,730,140 | B2 | 5/2014 | Liou et al. | |
| 8,878,829 | B2 | 11/2014 | Xiao | |
| 10,217,393 | B2 | 2/2019 | Noh et al. | |
| 2006/0044249 | A1 | 3/2006 | Lee et al. | |
| 2006/0214895 | A1 | 9/2006 | Shih et al. | |
| 2007/0008009 | A1* | 1/2007 | Son | H03K 17/165 326/87 |
| 2010/0245326 | A1 | 9/2010 | Xiao | |
| 2011/0199360 | A1* | 8/2011 | Fujiwara | G09G 3/3688 345/211 |
| 2012/0062542 | A1 | 3/2012 | Liou et al. | |
| 2013/0271682 | A1 | 10/2013 | Liou et al. | |
| 2016/0111054 | A1* | 4/2016 | Wang | G09G 3/3655 345/204 |
| 2016/0180764 | A1* | 6/2016 | Noh | G09G 3/2018 345/690 |
| 2017/0213495 | A1* | 7/2017 | Lee | G09G 3/2007 |

FOREIGN PATENT DOCUMENTS

| | | |
|---|---|---|
| CN | 101893773 | 11/2010 |
| CN | 102568430 | 7/2012 |
| CN | 103854628 | 6/2014 |
| CN | 105719607 | 6/2016 |
| TW | 201113855 | 4/2011 |
| TW | 201211989 | 3/2012 |

OTHER PUBLICATIONS

"Office Action of China Counterpart Application," dated Oct. 9, 2019, p. 1-p. 13.
"Office Action of China Counterpart Application", dated May 15, 2020, p. 1-p. 13.

* cited by examiner

DISPLAY APPARATUS AND SOURCE DRIVER THEREOF AND OPERATING METHOD

BACKGROUND OF THE INVENTION

Field of the Invention

The invention relates to an electronic apparatus, and more particularly, to a display apparatus, a source driver of the display apparatus and an operating method of the source driver.

Description of Related Art

FIG. 1 is a block diagram illustrating circuitry of a thin film transistor (TFT) liquid crystal display (LCD) 10. The TFT LCD 10 includes a timing controller 11, one or more gate drivers (e.g., 121_1 and 12_2 depicted in FIG. 1), one or more source drivers (e.g., 13_1, 13_2 and 13_3 depicted in FIG. 1) and a display panel 14. The display panel 14 is constituted by two substrates, and liquid crystal materials are filled between the two substrates. The display panel 14 is disposed with a plurality of source lines (or known as data lines, such as SL1, SL2 and SL3 depicted in FIG. 1), a plurality of gate lines (or known as scan lines, such as GL1, GL2 and GL3 depicted in FIG. 1) and a plurality of pixel units (e.g., P1, P2, P3, P4, P5, P6, P7, P8 and P9 depicted in FIG. 1). The source lines SL1, SL2 and SL3 are perpendicular to the gate lines GL1, GL2 and GL3. The pixel units P1 to P9 are distributed on the display panel 14 in form of an array. FIG. 1 illustrates an equivalent circuit diagram of pixel unit P3, and the other pixel units P1 to P2 and P4 to P9 may be deduced by reference with related description for the pixel unit P3.

The gate drivers 12_1 and 12_2 are coupled between the timing controller 11 and the display panel 14. The gate drivers 12_1 and 12_2 may drive (or scan) each of the gate lines of the display panel 14 one by one in succession according to timing sequences of a vertical start signal STV and a gate clock signal CPV. For example, the gate line GL1 is driven first, and then the gate lines GL2 and GL3 are driven sequentially. The timing controller 11 provides an output enable signal OE (or an output disable signal) to the gate drivers 12_1 and 12_2 via a control bus, so as to control pulses of gate driving signals outputted by the gate drivers 12_1 and 12_2.

The source drivers 13_1, 13_2 and 13_3 are coupled between the timing controller 11 and the display panel 14. The timing controller 11 sequentially outputs multiple line data (display data) to a data line bus DAT in a serial manner, so that the source drivers 13_1, 13_2 and 13_3 may obtain the display data from the data line bus DAT. The data line bus DAT is, for example, a bus in compliance with the Mini Low Voltage Differential Signaling (mini-LVDS) standard. Under control of a source clock signal CK and a horizontal start signal STH outputted by the timing controller 11, the source drivers 13_1, 13_2 and 13_3 may latch different digital pixel data of the data line bus DAT in corresponding drive channel circuits. Under control of a line latch signal LD, the source drivers 13_1, 13_2 and 13_3 may simultaneously convert the digital pixel data latched in the drive channel circuits into source driving signals. With scan time sequences of the gate drivers 12_1 and 12_2, the source driving signals may be written into multiple pixel units (e.g., P1, P2, P3, P4, P5, P6, P7, P8 and P9 depicted in FIG. 1) of the display panel 14 in order to display image.

The gate drivers 12_1 and 12_2 output the gate driving signals to the gate lines GL1, GL2 and GL3. A resistance-capacitance load (RC load) on the gate line may cause changes in an effective driving time of the gate driving signal. FIG. 1 illustrates an equivalent circuit diagram of the gate lines GL1, GL2 and GL3, wherein each segment of the gate line with respect to a pixel unit has an equivalent resistance (or a parasitic resistance). In each pixel unit such as shown in P3, an equivalent capacitance includes the capacitance of a liquid crystal capacitor, $C_{LC}$, and the capacitance of a storage capacitor, $C_{ST}$. The equivalent resistance and the equivalent/parasitic capacitance(s) form the RC load to the gate drivers.

FIG. 2 illustrates a waveform diagram of a gate driving signal on the gate line GL1 depicted in FIG. 1. As illustrated in FIG. 2, a horizontal axis represents time and a vertical axis represents voltage. Referring to FIG. 1 and FIG. 2, the gate driver 12_1 outputs a modulated pulse to the gate line GL1. Ideally (if the RC load does not exist on the gate line GL1), the same modulated pulse is received by the pixel units P1, P2 and P3 depicted in FIG. 1. However, in reality, the RC load does exist and increases along the direction of the gate line, which results in that the pixel units P1, P2, and P3 located in different locations in the gate line GL1 may receive waveforms of the gate driving pulse with different falling edge slopes. When the TFT switch is turned from ON state to OFF state, the voltage level of the pixel electrode decreases due to the influence of a parasitic capacitance $C_{GD}$ (also shown in P3 of FIG. 2) coupled to the pixel electrode. The decreased voltage is called a feed-through voltage $\Delta V_{GD}$, $\Delta V_{GD}=(V_{GL}-V_{GH})*C_{GD}/(C_{GD}+C_{LC}+C_{ST})$, where $V_{GL}$ is a low voltage level of the gate driving signal and $V_{GH}$ is a high voltage level of the gate driving signal. Since the waveform of the gate driving pulse varies in the gate line direction, the feed through voltage also varies in the gate line direction. The feed through voltage in the pixel unit closer to the input terminals of the gate lines may is greater than the feed through voltage in the pixel unit far from the input terminals of the gate lines. Due to the feed through voltage, the voltage between the pixel electrode and the common electrode is not the same as the expected and results in image flicker and image sticking. Said phenomenon is especially visible in large-size panels.

SUMMARY OF THE INVENTION

The invention is directed to a display apparatus, a source driver of the display apparatus and an operating method of the display apparatus, which are capable of using different compensation voltages to respectively compensate source driving voltages of different source lines of a display panel.

A display apparatus is provided according to embodiments of the invention, and the display apparatus includes a display panel, at least one gate driver and a plurality of source drivers. The display panel includes a plurality of source lines and a plurality of gate lines. A plurality of output terminals of the gate driver are coupled to the gate lines in one-to-one manner. A plurality of output terminals of the source drivers are coupled to the source lines in one-to-one manner to provide a plurality of source driving voltages to the source lines. The source driving voltages include different coarse compensation voltages. The coarse compensation voltages are respectively configured based on distances between the source drivers which control the source lines and input terminals of the gate lines of the display panel.

In an embodiment of the invention, the source driver includes a programmable gamma generating circuit and a plurality of drive channel circuits. The programmable gamma generating circuit may use one corresponding coarse compensation voltage among the coarse compensation voltages to respectively compensate original gamma voltages so as to provide a plurality of compensated gamma voltages. The drive channel circuits are coupled to the programmable gamma generating circuit to receive the compensated gamma voltages. Each of the drive channel circuits includes a digital-to-analog converter (DAC) and an output buffer. The DAC converts digital pixel data into a source driving voltage according to the compensated gamma voltages. A first input terminal of the output buffer is coupled to an output terminal of the DAC to receive the source driving voltage. The output buffer may output the source driving voltage to one corresponding source line among the source lines.

In an embodiment of the invention, the display apparatus further includes a timing controller. The timing controller is coupled to the source drivers and the gate driver. The timing controller provides different voltage setting instructions respectively to the programmable gamma generating circuits of the source drivers to set the compensated gamma voltages for each source driver. The voltage setting instructions respectively determine the coarse compensation voltages.

In an embodiment of the invention, a first source driver among the source drivers includes a programmable gamma generating circuit and a plurality of drive channel circuits. The programmable gamma generating circuit may use one corresponding coarse compensation voltage among the coarse compensation voltages to respectively compensate original gamma voltages so as to provide a plurality of compensated gamma voltages. A plurality of drive channel circuits are coupled to the programmable gamma generating circuit to receive the compensated gamma voltages and a plurality of fine compensation voltages. A plurality of output terminals of the drive channel circuits are coupled to the source lines with respect to the first source driver in one-to-one manner to provide a plurality of compensated source driving voltages with respect to the first source driver. The compensated source driving voltages with respect to the first source driver may include different fine compensation voltages which are respectively provided to the plurality of drive channel circuits. The fine compensation voltages are respectively configured based on distances between the source lines with respect to the first source driver and the input terminal of the gate lines.

In an embodiment of the invention, the source driver further includes a reference voltage generating unit. Each of the drive channel circuits includes a DAC and an output buffer. The DAC is coupled to the programmable gamma generating circuit to receive the compensated gamma voltages. The DAC converts digital pixel data into a source driving voltage according to the compensated gamma voltages. A first input terminal of the output buffer is coupled to an output terminal of the DAC to receive the source driving voltage. A second input terminal of the output buffer is coupled to the reference voltage generating unit to receive one corresponding reference voltage among a plurality of reference voltages. An output terminal of the output buffer outputs one of the compensated source driving voltages to one corresponding source line among the source lines with respect to the first source driver. The plurality of reference voltages are the fine compensation voltages and the corresponding compensated source driving voltage outputted by the output buffer is the source driving voltage outputted by the digital-to-analog converter plus one corresponding fine compensation voltage among the fine compensation voltages.

In an embodiment of the invention, the output buffer includes a first current source, a second current source, a first transistor, a second transistor, a third transistor, a fourth transistor and a gain and output stage. A control terminal of the first transistor is coupled to the first input terminal of the output buffer. A first terminal of the first transistor is coupled to the first current source. A control terminal of the second transistor is coupled to the output terminal of the output buffer. A first ten final of the second transistor is coupled to the first current source. A control terminal of the third transistor is coupled to the first input terminal of the output buffer. A first terminal of the third transistor is coupled to the second current source. A control terminal of the fourth transistor is coupled to the second input terminal of the output buffer. A first terminal of the fourth transistor is coupled to the second current source. A first input terminal of a first differential input pair of the gain and output stage is coupled to a second terminal of the first transistor and a second terminal of the third transistor. A second input terminal of said first differential input pair is coupled to a second terminal of the second transistor and a second terminal of the fourth transistor. An output terminal of the gain and output stage is coupled to the output terminal of the output buffer.

In an embodiment of the invention, the output buffer further includes a third current source, a fourth current source, a fourth transistor, a fifth transistor, a seventh transistor and an eighth transistor. A control terminal of the fifth transistor is coupled to the first input terminal of the output buffer. A first terminal of the fifth transistor is coupled to the third current source. A control terminal of the sixth transistor is coupled to the output terminal of the output buffer. A first terminal of the sixth transistor is coupled to the third current source. A control terminal of the seventh transistor is coupled to the first input terminal of the output buffer. A first terminal of the seventh transistor is coupled to the fourth current source. A control terminal of the eighth transistor is coupled to the second input terminal of the output buffer. A first terminal of the eighth transistor is coupled to the fourth current source. A first input terminal of a second differential input pair of the gain and output stage is coupled to a second terminal of the fifth transistor and a second terminal of the seventh transistor. A second input terminal of said second differential input pair is coupled to a second terminal of the sixth transistor and a second terminal of the eighth transistor.

In an embodiment of the invention, the reference voltage generating unit includes a resistor string. A first terminal of the resistor string receives a rough gamma voltage generated by the programmable gamma generating circuit. A plurality of voltage dividing nodes of the resistor string are respectively coupled to the second input terminals of the output buffers of the drive channel circuits in one-to-one manner.

In an embodiment of the invention, the reference voltage generating unit includes a plurality of resistor strings and a plurality of selection circuits. A plurality of first terminals of the resistor strings respectively receive a plurality of rough gamma voltages provided by the programmable gamma generating circuit in one-to-one manner. Output terminals of the selection circuits are respectively coupled to the second input terminals of the output buffers of the drive channel circuits in one-to-one manner. The selection circuits may selectively connect a plurality of voltage dividing nodes of the resistor strings respectively to the second input terminals of the output buffers in one-to-one manner.

In an embodiment of the invention, the reference voltage generating unit further includes a plurality of programmable current sources. The programmable current sources are respectively coupled to a plurality of second terminals of the resistor strings in one-to-one manner. The programmable current sources may provide current to the second terminals of the resistor strings or drain current from the second terminals of the resistor strings.

In an embodiment of the invention, one of the programmable current sources includes a first current source and a second current source. A current output terminal of the first current source is coupled to the second terminal of one corresponding resistor string among the resistor strings. The first current source determines whether to provide current to the second terminal of the corresponding resistor string according to a first control signal. A current input terminal of the second current source is coupled to the second terminal of the corresponding resistor string. The second current source determines whether to drain current from the second terminal of the corresponding resistor string according to a second control signal.

A source driver is provided according to embodiments of the invention, and the source driver may drive a plurality of source lines of a display panel. The source driver includes a programmable gamma generating circuit and a plurality of drive channel circuits. The programmable gamma generating circuit may provide a plurality of gamma voltages. A plurality of drive channel circuits are coupled to the programmable gamma generating circuit to receive the gamma voltages. A plurality of output terminals of the drive channel circuits are coupled to the source lines in one-to-one manner to provide a plurality of compensated source driving voltages to the source lines. The compensated source driving voltages include different fine compensation voltages. The fine compensation voltages are respectively configured based on distances between the source lines to input terminals of a plurality of gate lines of the display panel.

In an embodiment of the invention, the programmable gamma generating circuit is configured to use a coarse compensation voltage to respectively compensate original gamma voltages in such a way that each gamma voltage outputted by the programmable gamma generating circuit is a corresponding original gamma voltage plus the coarse compensation voltage.

In an embodiment of the invention, the source driver further includes a reference voltage generating unit. Each of the drive channel circuits includes a DAC and an output buffer. The DAC is coupled to the programmable gamma generating circuit to receive the gamma voltages. The DAC converts digital pixel data into a source driving voltage according to the gamma voltages. A first input terminal of the output buffer is coupled to an output terminal of the DAC to receive the source driving voltage. A second input terminal of the output buffer is coupled to the reference voltage generating unit to receive one corresponding reference voltage among a plurality of reference voltages. An output terminal of the output buffer outputs one of a plurality of compensated source driving voltages to one corresponding source line among the source lines. The reference voltages are a plurality of fine compensation voltages. The compensated source driving voltage outputted by the output buffer is the source driving voltage plus one corresponding fine compensation voltage among the fine compensation voltages.

In an embodiment of the invention, the output buffer includes a first current source, a second current source, a first transistor, a second transistor, a third transistor, a fourth transistor and a gain and output stage. A control terminal of the first transistor is coupled to the first input terminal of the output buffer. A first terminal of the first transistor is coupled to the first current source. A control terminal of the second transistor is coupled to the output terminal of the output buffer. A first terminal of the second transistor is coupled to the first current source. A control terminal of the third transistor is coupled to the first input terminal of the output buffer. A first terminal of the third transistor is coupled to the second current source. A control terminal of the fourth transistor is coupled to the second input terminal of the output buffer. A first terminal of the fourth transistor is coupled to the second current source. A first input terminal of a first differential input pair of the gain and output stage is coupled to a second terminal of the first transistor and a second terminal of the third transistor. A second input terminal of said first differential input pair is coupled to a second terminal of the second transistor and a second terminal of the fourth transistor. An output terminal of the gain and output stage is coupled to the output terminal of the output buffer.

In an embodiment of the invention, the output buffer further includes a third current source, a fourth current source, a fourth transistor, a fifth transistor, a seventh transistor and an eighth transistor. A control terminal of the fifth transistor is coupled to the first input terminal of the output buffer. A first terminal of the fifth transistor is coupled to the third current source. A control terminal of the sixth transistor is coupled to the output terminal of the output buffer. A first terminal of the sixth transistor is coupled to the third current source. A control terminal of the seventh transistor is coupled to the first input terminal of the output buffer. A first terminal of the seventh transistor is coupled to the fourth current source. A control terminal of the eighth transistor is coupled to the second input terminal of the output buffer. A first terminal of the eighth transistor is coupled to the fourth current source. A first input terminal of a second differential input pair of the gain and output stage is coupled to a second terminal of the fifth transistor and a second terminal of the seventh transistor. A second input terminal of said second differential input pair is coupled to a second terminal of the sixth transistor and a second terminal of the eighth transistor.

In an embodiment of the invention, the reference voltage generating unit includes one resistor string. A first terminal of the resistor string receives a rough gamma voltage generated by the programmable gamma generating circuit. A plurality of voltage dividing nodes of the resistor string are respectively coupled to the second input terminals of the output buffers of the drive channel circuits in one-to-one manner.

In an embodiment of the invention, the reference voltage generating unit includes a plurality of resistor strings and a plurality of selection circuits. A plurality of first terminals of the resistor strings respectively receive a plurality of rough gamma voltages provided by the programmable gamma generating circuit in one-to-one manner. Output ten finals of the selection circuits are respectively coupled to the second input terminals of the output buffers of the drive channel circuits in one-to-one manner. The selection circuits may selectively connect a plurality of voltage dividing nodes of the resistor strings respectively to the second input terminals of the output buffers in one-to-one manner.

In an embodiment of the invention, the reference voltage generating unit further includes a plurality of programmable current sources. The programmable current sources are respectively coupled to a plurality of second terminals of the resistor strings in one-to-one manner. The programmable current sources are configured to provide current to the second terminals of the resistor strings or drain current from the second terminals of the resistor strings.

In an embodiment of the invention, one of the programmable current sources includes a first current source and a second current source. A current output terminal of the first current source is coupled to the second terminal of one corresponding resistor string among the resistor strings. The first current source determines whether to provide current to the second terminal of the corresponding resistor string according to a first control signal. A current input terminal of the second current source is coupled to the second terminal of the corresponding resistor string. The second current source determines whether to drain current from the second terminal of the corresponding resistor string according to a second control signal.

An operating method of a source driver is provided according to embodiments of the invention. The source driver is configured to drive a plurality of source lines of a display panel. The operation method includes: providing a plurality of gamma voltages to a plurality of drive channel circuits of the source driver; respectively providing different fine compensation voltages to the drive channel circuits; respectively compensating a plurality of source driving voltages by using the fine compensation voltages to obtain a plurality of compensated source driving voltages by the drive channel circuits; and providing the compensated source driving voltages to the source lines in one-to-one manner by the drive channel circuits.

In an embodiment of the invention, the operation method further includes: using a coarse compensation voltage to respectively compensate a plurality of original gamma voltages to generate the plurality of gamma voltages, in such a way that each gamma voltage is a corresponding original gamma voltage plus the coarse compensation voltage.

Based on the above, according to the display apparatus, the source driver of the display apparatus and the operating method of the display apparatus as described in the embodiments of the invention, the different compensation voltages may be used to respectively compensate the source driving voltages of the different source lines of the display panel. The compensated source driving voltages may solve the problem of display errors caused by the different gate falling edge slopes for the pixel units.

To make the above features and advantages of the present disclosure more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
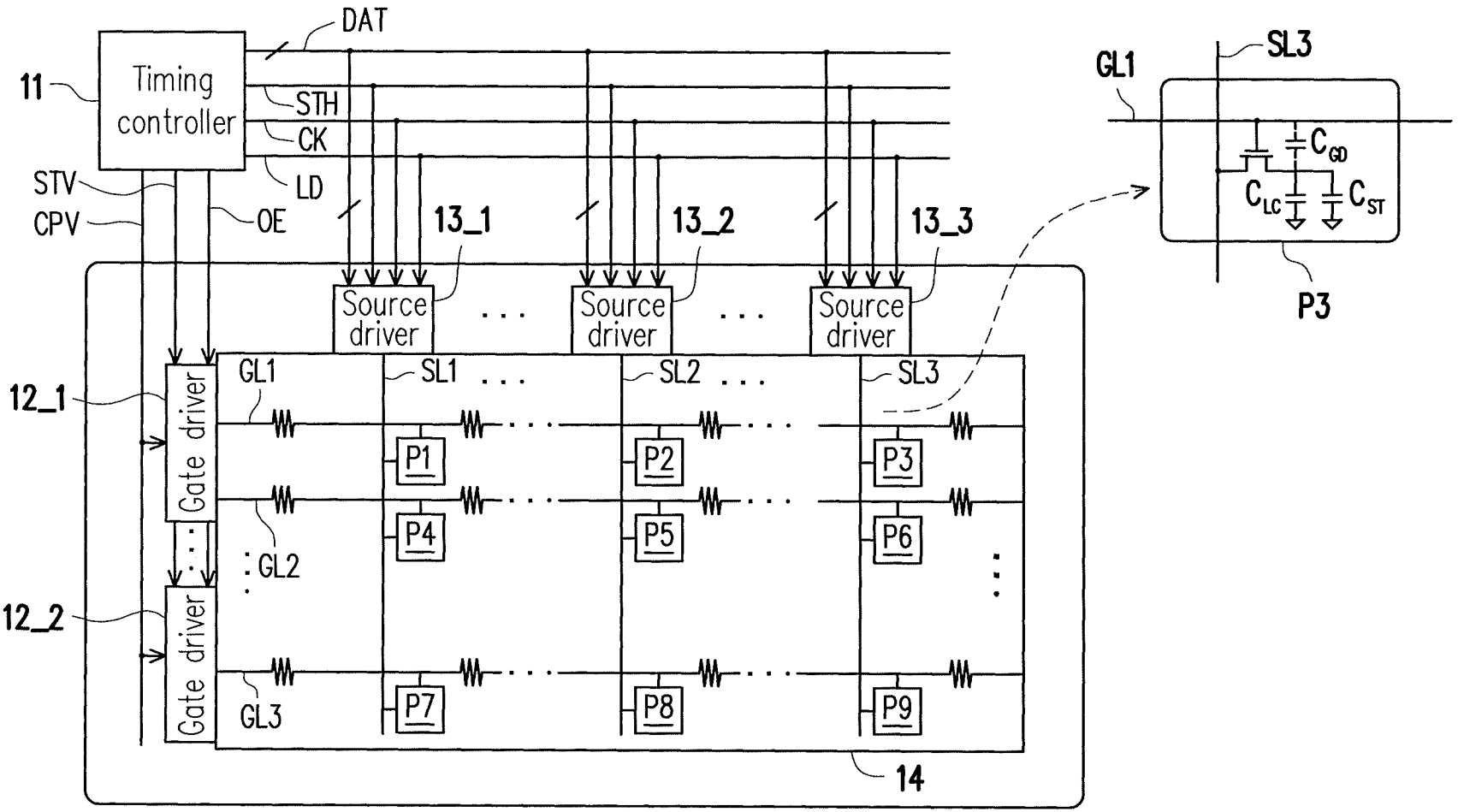
FIG. 1 (RELATED ART)
FIG. 1 is a block diagram illustrating circuitry of a thin film transistor liquid crystal display.
Figure 2:
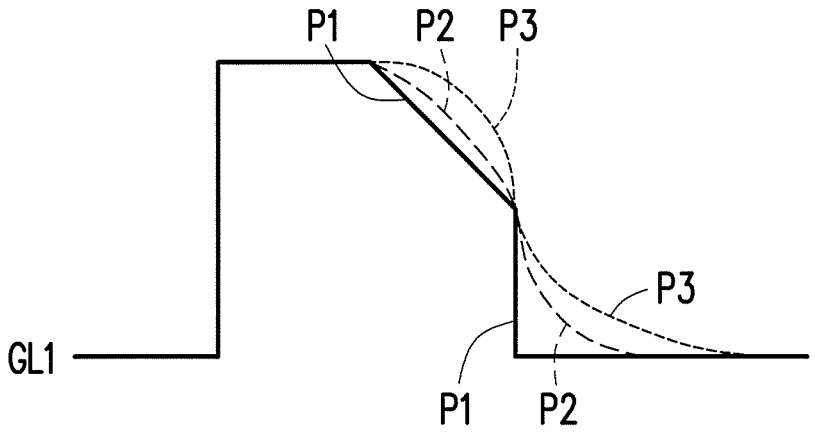
FIG. 2 (RELATED ART)
FIG. 2 illustrates a waveform diagram of a gate driving signal on the gate line GL1 depicted in FIG. 1.

Reference will now be made in detail to the present preferred embodiments of the invention, examples of which are illustrated in the accompanying drawings. Wherever possible, the same reference numbers are used in the drawings and the description to refer to the same or like parts.

The term "coupled (or connected)" used in this specification (including claims) may refer to any direct or indirect connection means. For example, "a first device is coupled (connected) to a second device" should be interpreted as "the first device is directly connected to the second device" or "the first device is indirectly connected to the second device through other devices or connection means". Moreover, wherever appropriate in the drawings and embodiments, elements/components/steps with the same reference numerals represent the same or similar parts. Elements/components/steps with the same reference numerals or names in different embodiments may be cross-referenced.

Figure 3:
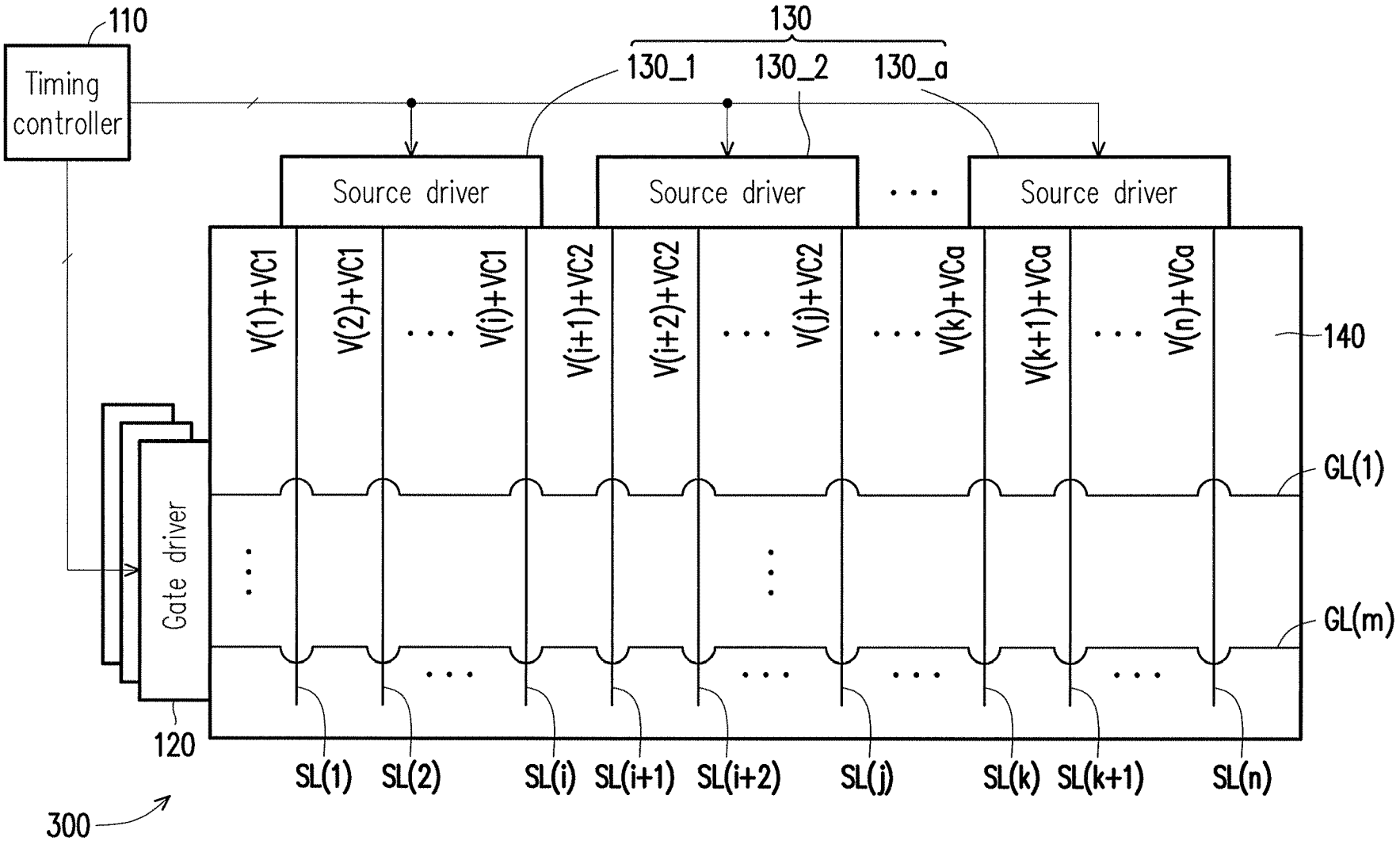
FIG. 3 is a block diagram illustrating circuitry of a display apparatus according to an embodiment of the invention.

FIG. 3 is a block diagram illustrating circuitry of a display apparatus 300 according to an embodiment of the invention. The display apparatus 300 includes a timing controller 110, at least one gate driver 120, a plurality of source drivers 130 and a display panel 140. In the embodiment of FIG. 3, the source driver 130 may include a first source driver 130_1, a second source driver 130_2, . . . , an $a^{th}$ source driver **130_*a*, wherein a is a positive integer. The timing controller 110 may be coupled to the source drivers 130_1 to 130_*a* and the gate driver 120**.

The display panel 140 includes a plurality of source lines and a plurality of gate lines, such as source lines SL(1), SL(2), . . . , SL(i), SL(i+1), SL(i+2), . . . , SL(j), . . . , SL(k), SL(k+1), . . . , SL(n) depicted in FIG. 3 and gate lines GL(1), . . . , GL(m) depicted in FIG. 3, wherein i, j, k, m and n are positive integers and $0<i<j<k<n$. A plurality of output terminals of the gate driver 120 are coupled to the different gate lines GL(1) to GL(m) in one-to-one manner. The gate driver 120, the display panel 140, the source lines SL(1) to SL(n) and the gate lines GL(1) to GL(m) depicted in FIG. 3 may be deduced by reference with related descriptions for the gate drivers 12_1 to 12_2, the display panel 14, the source lines SL1 to SL3 and the gate lines GL1 to GL3 depicted in FIG. 1, which are not repeated hereinafter.

A plurality of output terminals of the source driver 130 are coupled to the source lines SL(1) to SL(n) in one-to-one manner. For a source line, a corresponding source driver may output a compensated source driving voltage equivalent to an original source driving voltage plus a coarse compensation voltage to the source line. The coarse compensation voltage compensates the original source driving voltage for potential difference caused by feed through voltage $\Delta V_{GD}$. The compensated source driving voltages outputted from the source drivers 130_1 to **130_*a* include respective coarse compensation voltages for different source drivers. As shown in the example of FIG. 3, a plurality of original source driving voltages with respect to all the source lines are V(1), V(2), . . . , V(i), V(i+1), V(i+2), . . . , V(j), . . . , V(k), V(k+1), . . . , V(n), where V(x) indicates the original source driving voltage with respect to the x-th source line. For instance, assuming that a current image frame is a single color frame (e.g., a white frame), the original source driving voltages V(1) to V(n) may be the same. A plurality of coarse compensation voltages VC1 to VCa are respectively configured to generate the compensated source driving voltages. For instance, the source driver 130_1 may use the coarse compensation voltage VC1 to compensate the original source driving voltages V(1) to V(i), the source driver 130_2 may use the coarse compensation voltage VC2 to compensate the original source driving voltages V(i+1) to V(j), and the source driver 130_*a* may use the coarse compensation voltage VCa to compensate the original source driving voltages V(k) to V(n), as shown by FIG. 3**.

Herein, the coarse compensation voltages VC1 to VCa are respectively configured based on different (horizontal) distances between the source drivers which control the source lines and the gate driver. Precisely, the coarse compensation voltages VC1 to VCa are respectively configured based on different (horizontal) distances between the source drivers which control the source lines and input terminals of the gate lines of the display panel. For instance (but not limited thereto), as the distances between the source drivers and the input terminals of the gate lines increase, the coarse compensation voltages VC1 to VCa may be gradually decreased (since the feed through voltage decreases). In other words, because the source lines SL(1) to SL(i) connected to the source driver 130_1 are closest to the input terminal of the gate lines, the coarse compensation voltage VC1 may be greater than the other coarse compensation voltages VC2 to VCa. Because the source lines SL(k) to SL(n) connected to the source driver **130_*a* are farthest from the input terminal of the gate lines, the coarse compensation voltage VCa may be a smallest one among the coarse compensation voltages VC1 to VCa. The coarse compensation voltages VC1 to VCa may be determined based on a characteristic of the display panel 140**.

For instance (but not limited thereto), with use of a 65-inch 4K2K display panel (120 Hz), the display apparatus 300 may have 12 source drivers 130_1 to 130_12 (each of the source drivers has 960 drive channel circuits) disposed on a top edge of the display panel 140, and two gate drivers 120 respectively drive from left terminals of the gate lines GL(1) to GL(m) and from right terminals of the gate lines GL(1) to GL(m) in a horizontal symmetric manner. The source lines connected to the source drivers 130_1 and 130_12 are respectively closest to the gate drivers 120, and the source lines connected to the source drivers 130_6 and 130_7 are respectively farthest from the gate drivers 120. Based on a characteristic of the 65-inch 4K2K display panel (120 Hz), the coarse compensation voltages VC1 to VC12 with respect to the source drivers 130_1 to 130_12 may be: VC1=VC12≈0.52V, VC2=VC11≈0.22V, VC3=VC10≈0.08V, VC4=VC9≈0.02V, VC5=VC8≈0.005V, and VC6=VC7≈0.001V.

Figure 4:
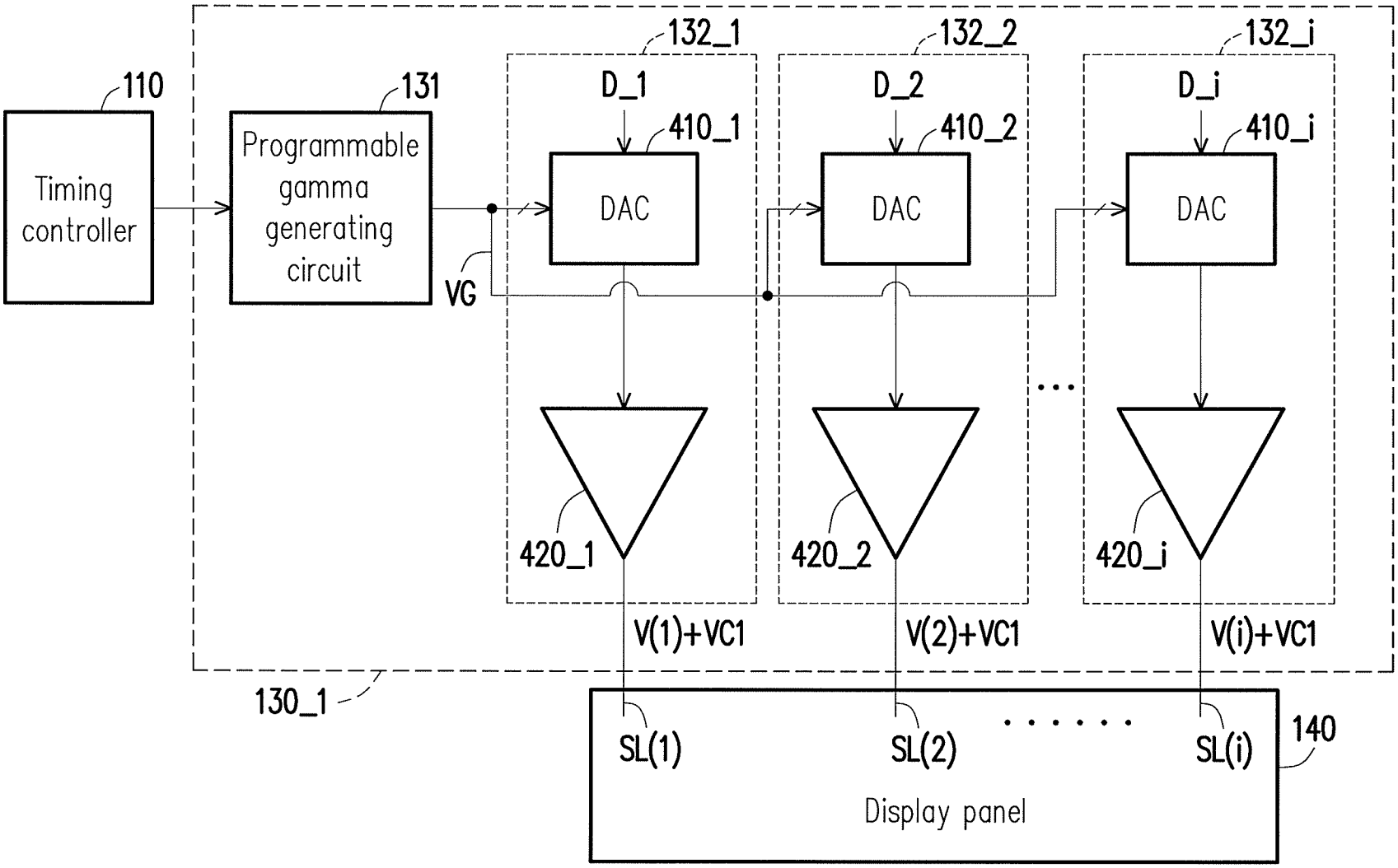
FIG. 4 is a block diagram illustrating circuitry of the source driver depicted in FIG. 3 according to an embodiment of the invention.

FIG. 4 is a block diagram illustrating circuitry of the source driver 130_1 depicted in FIG. 3 according to an embodiment of the invention. The other source drivers 130_2 to **130_*a* depicted in FIG. 3 may be deduced by reference with related description for the source driver 130_1. Referring to FIG. 4, the source driver 130_1 may include a programmable gamma generating circuit 131 and a plurality of drive channel circuits 132_1, 132_2, . . . , 132_*i*. The programmable gamma generating circuit 131 may provide a plurality of compensated gamma voltages VG. In generating the plurality of compensated gamma voltages VG (such as for displaying 256 grayscales), the programmable gamma generating circuit 131 takes the coarse compensation voltage VC1 into account, e.g., adds the coarse compensation voltage VC1 to each of original (uncompensated) gamma voltages, in such a way that every outputted compensated gamma voltage includes the coarse compensation voltage VC1. The compensated gamma voltages VG are outputted to all the drive channel circuits 132_1 to 132_*i* of the source driver 130_1**.

Each of the drive channel circuits 132_1 to **132_*i* includes a digital-to-analog converter (DAC) and an output buffer. For example, the drive channel circuit 132_1 includes a DAC 410_1 and an output buffer 420_1, the drive channel circuit 132_2 includes a DAC 410_2 and an output buffer 420_2, and the drive channel circuit 132_*i* includes a DAC 410_*i* and an output buffer 420_*i*. Each of the drive channel circuits 132_1 to 132_*i* may also include a latch not illustrated (configured to provide digital pixel data D_1, D_2**, . . . , D_*i* to the digital-to-analog converters 410_1 to **410_*i*) and the latch is well known by persons skilled in the art so that related description is not omitted herein. The drive channel circuit 132_1 will be described as follows, and the other drive channel circuits 132_2 to 132_*i* of the source driver 130_1 may be deduced by reference with related description for the drive channel circuit 132_1**.

In the drive channel circuit 132_1, because the compensated gamma voltages VG all include the coarse compensation voltage VC1, DAC 410_1 may select, from the compensated gamma voltages VG, a compensated gamma voltage corresponding to the digital pixel data D_1, which is V(1)+VC1 to be the compensated source driving voltage. In other words, the DAC 410_1 converts the digital pixel data D_1 into the compensated source driving voltage according to the compensated gamma voltages VG. A first input terminal of the output buffer 420_1 is coupled to an output terminal of the DAC 410_1 to receive the compensated source driving voltage, and the output buffer 420_1 is used for providing enough driving current. The output buffer 420_1 may output the compensated source driving voltage V(1)+VC1 to one corresponding source line SL(1) among the source lines SL(1) to SL(i). In another aspect, if the programmable gamma generating circuit 131 does not take the coarse compensation voltage VC1 into account and outputs original (uncompensated) gamma voltages to DAC 410_1 to DAC **410_*i*, DAC 410_1 may select, from the uncompensated gamma voltages, an uncompensated gamma voltage V(1) corresponding to the digital pixel data D_1** to be as the uncompensated source driving voltage.

Aforesaid settings of the programmable gamma generating circuit 131 for the coarse compensation voltage VC1 may be realized by any means. In some embodiments, the predetermined coarse compensation voltage VC1 may be regularly recorded in the programmable gamma generating circuit 131, so that the programmable gamma generating circuit 131 may use the coarse compensation voltage VC1 to compensate original (uncompensated) gamma voltages, so as to generate the compensated gamma voltages VG. In some other embodiments, the timing controller 110 may provide different voltage setting instructions respectively to the programmable gamma generating circuits of the source drivers 130_1 to **130_*a* (e.g., the programmable gamma generating circuit 131 of the source driver 130_1), so as to set the compensated gamma voltages of the source drivers 130_1 to 130_*a*. The different voltage setting instructions may determine the different compensated gamma voltages VG for different source drivers. Therefore, the timing controller 110 may control the programmable gamma generating circuit 131 by using the voltage setting instructions, so as to determine the coarse compensation voltage VC1 to be used in the source driver 130_1**.

Figure 5:
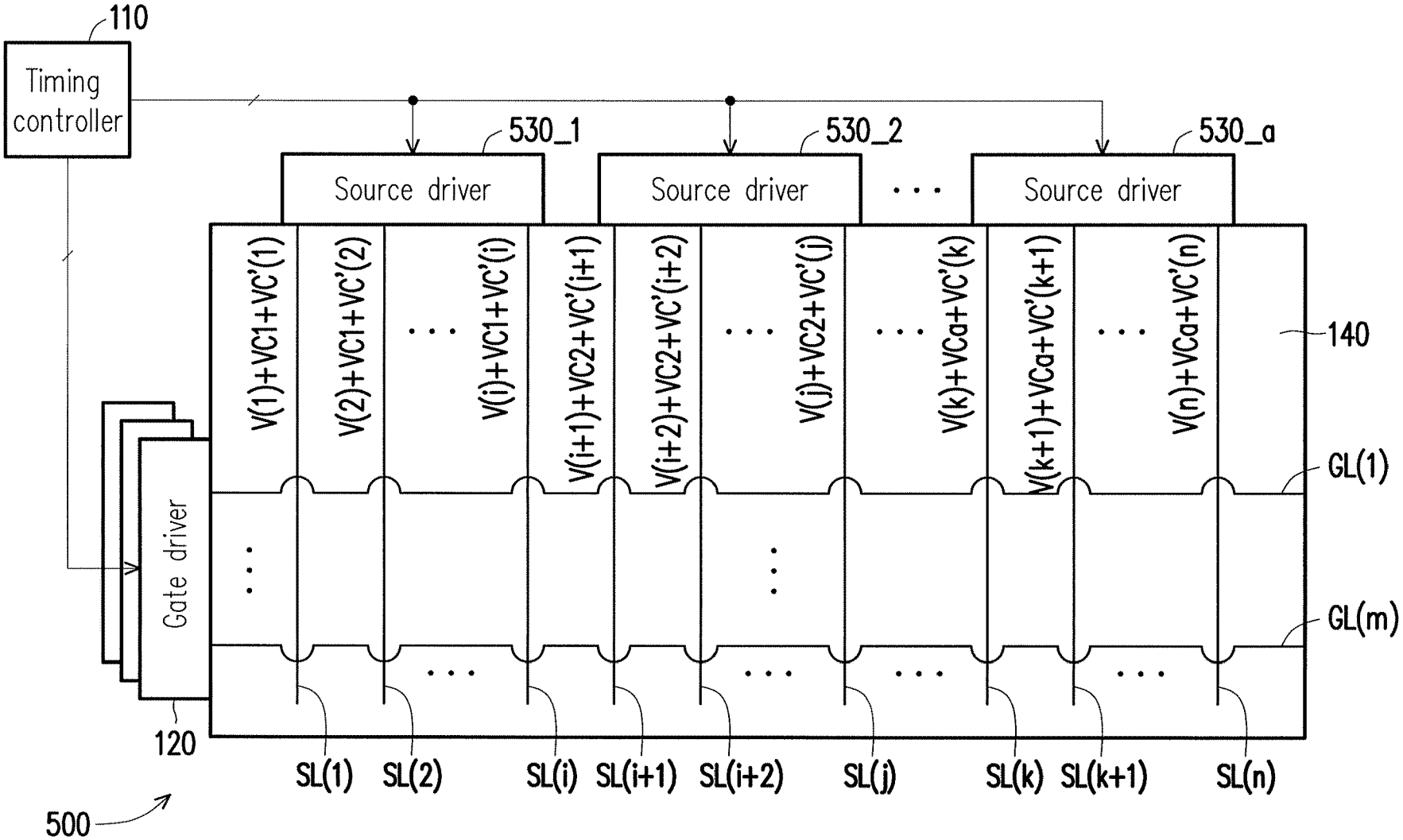
FIG. 5 is a block diagram illustrating circuitry of a display apparatus according to another embodiment of the invention.

FIG. 5 is a block diagram illustrating circuitry of a display apparatus 500 according to another embodiment of the invention. The display apparatus 500 includes a timing controller 110, at least one gate driver 120, a plurality of source drivers (e.g., source drivers 530_1, 530_2, . . . , **530_*a*) and a display panel 140. The timing controller 110, the gate driver 120, the display panel 140, the source lines SL(1) to SL(n) and the gate lines GL(1) to GL(m) depicted in FIG. 5 may be deduced by reference with related descriptions depicted in FIG. 3**, which are not repeated hereinafter.

In the embodiment shown in FIG. 5, compensated source driving voltages generated by different drive channel circuits in each of the source drivers 530_1 to **530_*a* may include different fine compensation voltages. For instance, for the source line SL(i), the corresponding source driver 530_1 may output a compensated source driving voltage equivalent to an original source driving voltage V(i) plus a coarse compensation voltage VC1 and plus a fine compensation voltage VC'(i). The coarse compensation voltage VC1 and the fine compensation voltage VC'(i) compensates the original source driving voltage V(i) for potential difference caused by feed through voltage $\Delta V_{GD}$. The source driver 530_1 may use the same coarse compensation voltage VC1 and different fine compensation voltages VC'(1), VC'(2), . . . , VC'(i) respectively to compensate the original source driving voltages V(1), V(2), . . . , V(i), so as to generate compensated source driving voltages V(1)+VC1+VC'(1), V(2)+VC1+VC'(2), . . . , V(i)+VC1+VC'(i) to the source lines SL(1) to SL(i). The source driver 530_2 may use the same coarse compensation voltage VC2 and different fine compensation voltages VC'(i+1), VC'(i+2), . . . , VC'(j) respectively to compensate the original source driving voltages V(i+1), V(i+2), . . . , V(j), so as to generate compensated source driving voltages V(i+1)+VC2+VC'(i+1), V(i+2)+VC2+VC'(i+2), . . . , V(j)+VC2+VC'(j) to the source lines SL(i+1) to SL(j). The source driver 530_*a*** may use the same coarse compensation voltage VCa and different fine compensation voltages VC'(k), VC'(k+1), . . . , VC'(n) respectively to compensate the original source driving voltages V(k), V(k+1), . . . , V(n), so as to generate compensated source driving voltages V(k)+VCa+VC'(k), V(k+1)+VCa+VC'(k+1), . . . , V(n)+VCa+VC'(n) to the source lines SL(k) to SL(n).

Herein, for each source driver, the fine compensation voltages are respectively configured by different distances from the source lines (with respect to each source driver) to the gate driver. Precisely, the fine compensation voltages are respectively configured by different distances between the source lines with respect to the source driver and the input terminals of the gate lines of the display panel. For instance (but not limited thereto), for the source driver 530_1, as the distances between the source lines and the input terminals of the gate lines increase, the fine compensation voltages may be gradually decreased. In other words, because the source line SL(1) among the source lines SL(1) to SL(i) is closest to the input terminal of the gate lines, the fine compensation voltage VC'(1) may be greater than the other fine compensation voltages VC'(2) to VC'(i); and because the source line SL(i) among the source lines SL(1) to SL(i) is farthest from the input terminal of the gate lines, the fine compensation voltage VC'(i) may be a smallest one among the fine compensation voltages VC'(1) to VC'(i). The fine compensation voltages VC'(1) to VC'(i) may be determined based on a characteristic of the display panel 140.

Figure 6:
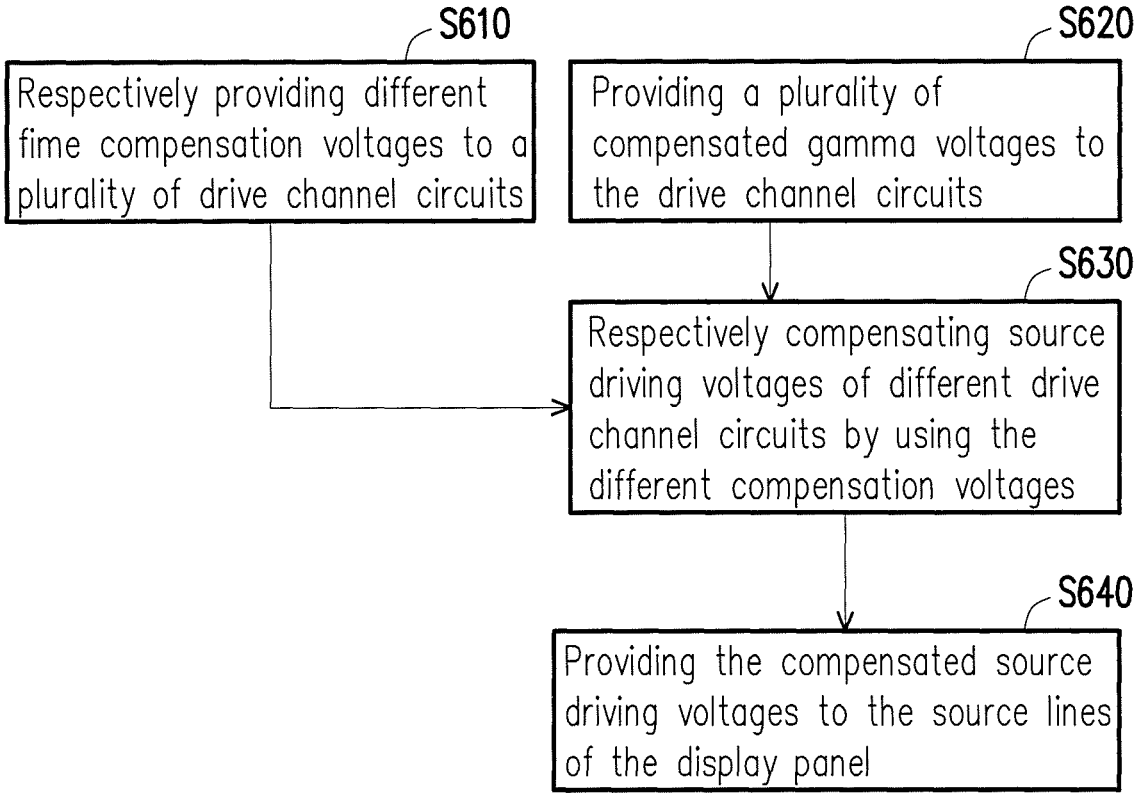
FIG. 6 is a flowchart illustrating an operating method of a source driver according to an embodiment of the invention.

FIG. 6 is a flowchart illustrating an operating method of a source driver according to an embodiment of the invention. In step S610, different fine compensation voltages are respectively provided to a plurality of drive channel circuits of the source driver. In step S620, a plurality of compensated gamma voltages in which a coarse compensation voltage is already added are provided to the drive channel circuits of the source drivers. In step S630, the drive channel circuits use the fine compensation voltages provided in step S610 to respectively compensate source driving voltages selected by different drive channel circuits from the plurality of compensated gamma voltages. In step S640, the drive channel circuits provide the compensated source driving voltages to the source lines of the display panel in one-to-one manner.

Figure 7:
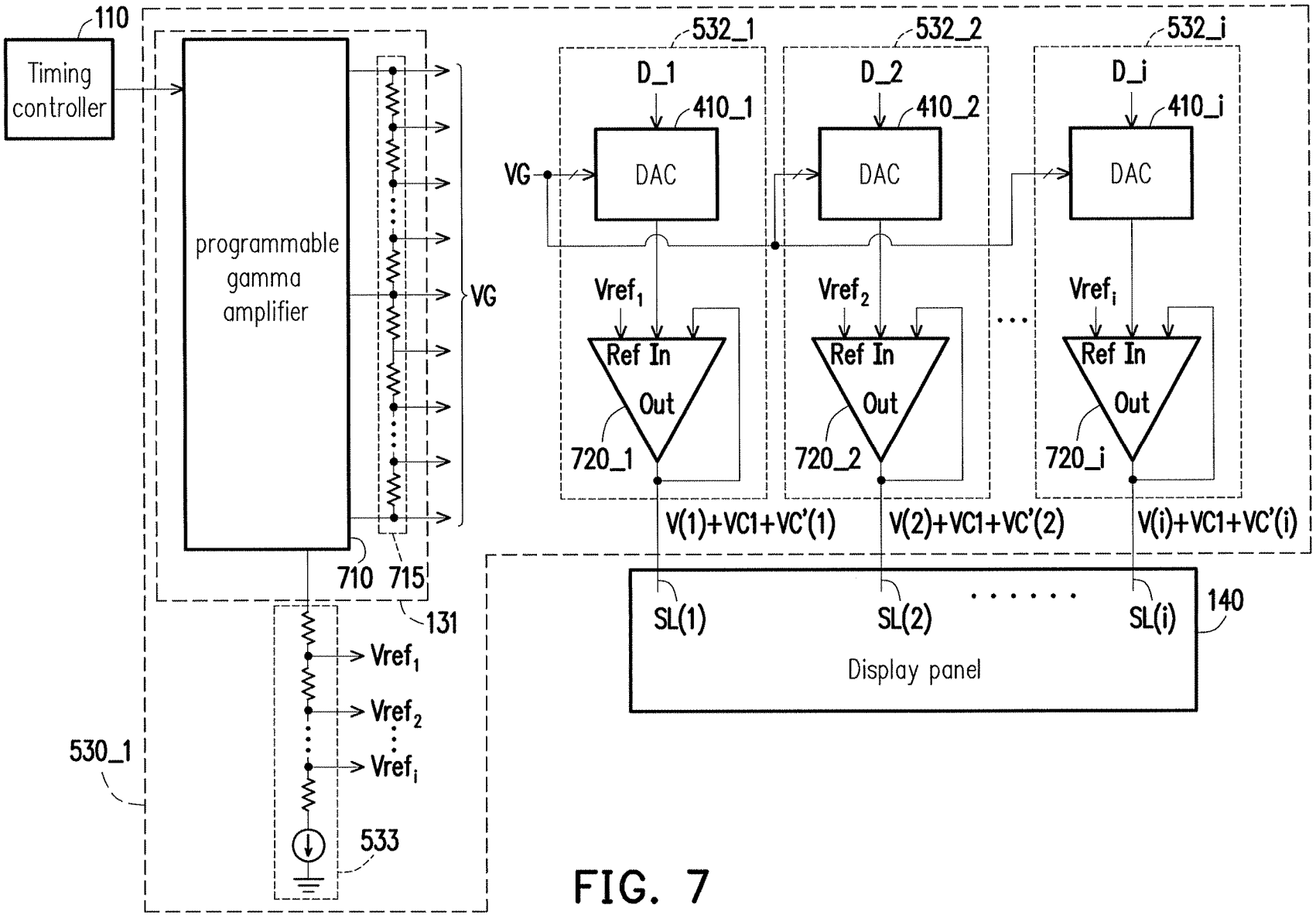
FIG. 7 is a block diagram illustrating circuitry of the source driver depicted in FIG. 5 according to an embodiment of the invention.

FIG. 7 is a block diagram illustrating circuitry of the source driver 530_1 depicted in FIG. 5 according to an embodiment of the invention. The other source drivers 530_2 to **530_*a* depicted in FIG. 5 may be deduced by reference with related description for the source driver 530_1. Referring to FIG. 7, the source driver 530_1 may include a programmable gamma generating circuit 131, a reference voltage generating unit 533 and a plurality of drive channel circuits 532_1, 532_2, . . . , 532_*i*. The programmable gamma generating circuit 131 may provide a plurality of compensated gamma voltages VG. The programmable gamma generating circuit 131 and the compensated gamma voltages VG (in which the coarse compensation voltage is added) depicted in FIG. 7 may be deduced by reference with related description for FIG. 4. The compensated gamma voltages VG are outputted to all the drive channel circuits 532_1 to 532_*i* of the source driver 530_1 (step S620**).

In the embodiment of FIG. 7, the programmable gamma generating circuit 131 includes a programmable gamma amplifier 710 and a gamma resistor string 715. The timing controller 110 may control the programmable gamma amplifier 710 by using the voltage setting instructions, so as to generate a plurality of rough compensated gamma voltages, such as three rough compensated gamma voltages shown in FIG. 7, to the gamma resistor string 715. More specifically, the timing controller 110 may add the coarse compensation voltage VC1 to the rough original gamma voltages generated by the programmable gamma amplifier 710 by using the voltage setting instructions so as to generate the rough compensated gamma voltages. The rough compensated gamma voltages generated by the programmable gamma amplifier 710 are transmitted to different voltage dividing nodes of the gamma resistor string 715, as shown by FIG. 7. Therefore, the gamma resistor string 715 may further divide the rough compensated gamma voltages generated by the programmable gamma amplifier 710 into more voltages having different levels, i.e., the compensated gamma voltages VG.

Output terminals of the drive channel circuits 532_1 to **532_*i* are coupled to the source lines SL(1) to SL(i) of the display panel 140 in one-to-one manner to provide a plurality of source driving voltages V(1) to V(i). The drive channel circuits 532_1 to 532_*i* may receive the different fine compensation voltage VC'(1) to VC'(i) (step S610). The drive channel circuits 532_1 to 532_*i* use the fine compensation voltages VC'(1) to VC'(i) to respectively compensate the corresponding source driving voltages selected by different drive channel circuits from the plurality of compensated gamma voltages VG (in which the coarse compensation voltage VC1 is already added) (step S630). For example, the drive channel circuit 532_1 may add the fine compensation voltage VC'(1) to a source driving voltage equivalent to V(1)+VC1 which is selected from the compensation gamma voltage VG, and then output the compensated source driving voltage V(1)+VC1+VC'(1) to the source line SL(1). Similarly, the drive channel circuit 532_*i* may add the fine compensation voltage VC'(i) to a source driving voltage equivalent to V(i)+VC1 which is selected from the compensation gamma voltage VG, and then output the compensated source driving voltage V(i)+VC1+VC'(i) to the source line SL(i). Each of the drive channel circuits 532_1 to 532_*i* includes a DAC and an output buffer. For example, the drive channel circuit 532_1 includes a DAC 410_1 and an output buffer 720_1, the drive channel circuit 532_2 includes a DAC 410_2 and an output buffer 720_2, and the drive channel circuit 532_*i* includes a DAC 410_*i* and an output buffer 720_*i*. Each of the drive channel circuits 532_1 to 532_*i* may also include a latch not illustrated (configured to provide digital pixel data D_1, D_2**, . . . , D_*i* to the digital-to-analog converters 410_1 to **410_*i*) and the latch is well known by persons skilled in the art so that related description is not omitted herein. The drive channel circuit 532_1 will be described as follows, and the other drive channel circuits 532_2 to 532_*i* of the source driver 530_1 may be deduced by reference with related description for the drive channel circuit 532_1**.

In the drive channel circuit 532_1, because the compensated gamma voltages VG all include the coarse compensation voltage VC1, the DAC 410_1 may select, from the compensated gamma voltages VG, a compensated gamma voltage corresponding to the digital pixel data D_1, which is V(1)+VC1 to be a first-step compensated source driving voltage. In other words, the DAC 410_1 converts the digital pixel data D_1 into the first-step compensated source driving voltage according to the compensated gamma voltages VG. A first input terminal In of the output buffer 720_1 is coupled to an output terminal of the DAC 410_1 to receive the first-step compensated source driving voltage V(1)+VC1.

In the embodiment of FIG. 7, the reference voltage generating unit 533 includes one resistor string. A first terminal of the resistor string of the reference voltage generating unit 533 receives a rough gamma voltage provided by the programmable gamma amplifier 710 of the programmable gamma generating circuit 131. A second terminal of the resistor string of the reference generating unit 533 is coupled to a current source. A plurality of voltage dividing nodes of the resistor string of the reference voltage generating unit 533 are respectively coupled to second input terminals Ref of the output buffers 720_1 to **720_*i* of the drive channel circuits 532_1 to 532_*i* in one-to-one manner, so as to provide a plurality of reference voltages $Vref_1$, $Vref_2$, $Vref_i$, as shown by FIG. 7**.

The second input terminal Ref of the output buffer 720_1 is coupled to the reference voltage generating unit 533 to receive one corresponding reference voltage $Vref_1$ among the reference voltages $Vref_i$ to $Vref_i$. The reference voltage generating unit 533 may provide the reference voltage $Vref_i$ to the output buffer 720_1 to be as the fine compensation voltage VC'(1). Therefore, the output buffer 720_1 may add the fine compensation voltage VC'(1) to the first-step compensated source driving voltage V(1)+VC1 outputted by the DAC 410_1 according to the reference voltage $Vref_i$, and then output a second-step compensated source driving voltage V(1)+VC1+VC'(1) to the source line SL(1). By analogy, the other reference voltages $Vref_2$ to $Vref_i$ are respectively provided to the second input terminals Ref of the output buffers 720_2 to **720_*i*. The reference voltage generating unit 533 may provide the reference voltages $Vref_2$ to $Vref_i$ to be as the fine compensation voltage VC'(2) to VC'(i) to the output buffers 720_2 to 720_*i*. Therefore, the output buffers 720_2 to 720_*i* may respectively add the fine compensation voltage VC'(2) to VC'(i) to the first-step compensated source driving voltages V(2)+VC1, . . . V(i)+VC1 according to the reference voltages $Vref_2$ to $Vref_i$, and respectively output second-step compensated source driving voltages V(2)+VC1+VC'(2), . . . V(i)+VC1+VC'(i), to the source lines SL(2**) to SL(i).

Figure 8:
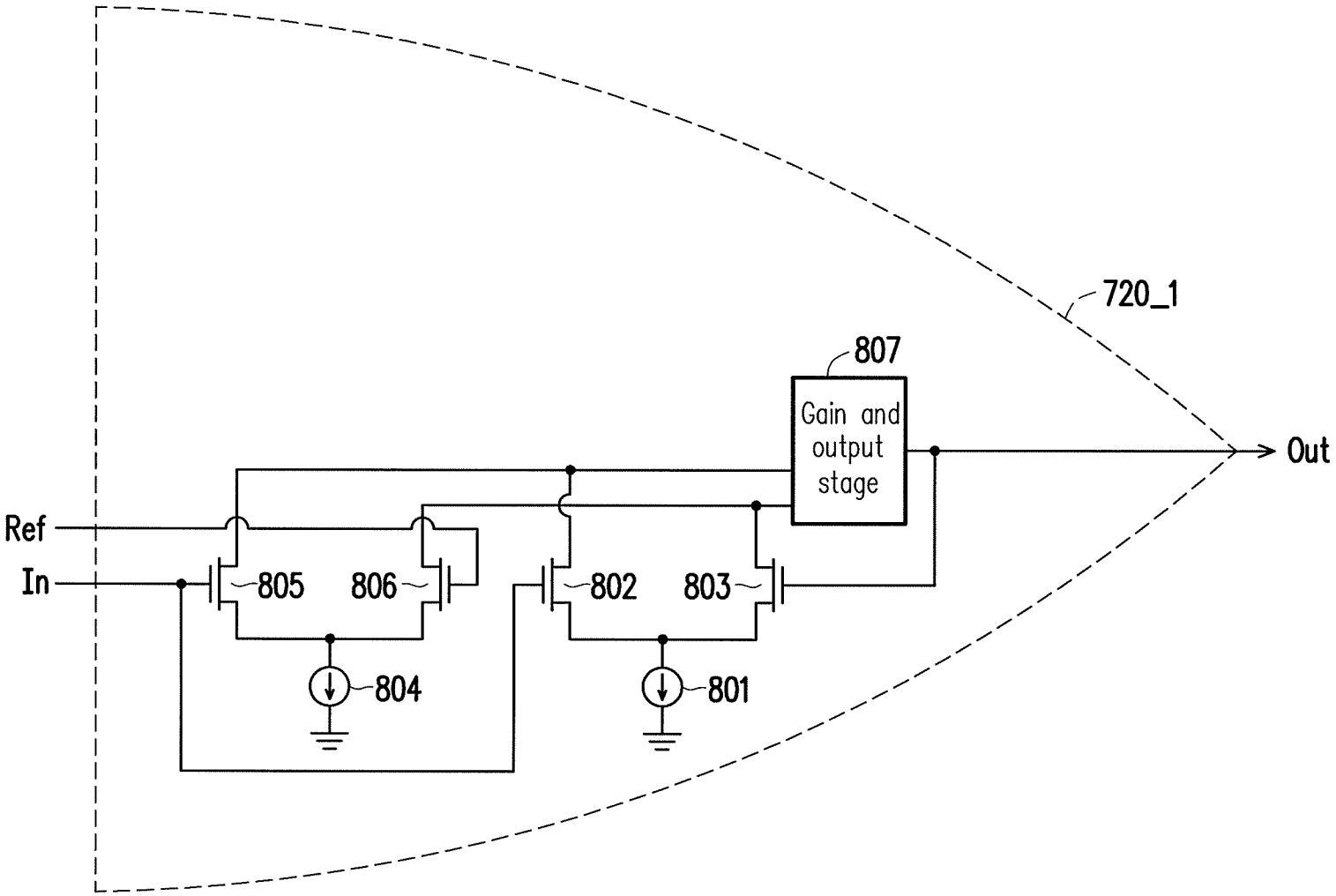
FIG. 8 is a block diagram illustrating circuitry of the output buffer depicted in FIG. 7 according to an embodiment of the invention.

FIG. 8 is a block diagram illustrating circuitry of the output buffer 720_1 depicted in FIG. 7 according to an embodiment of the invention. The other output buffers 720_2 to **720_*i* depicted in FIG. 7 may be deduced by reference with related description for the output buffer 720_1. Referring to FIG. 8, the output buffer 720_1 includes a first current source 801, a first transistor 802, a second transistor 803, a second current source 804, a third transistor 805, a fourth transistor 806 and a gain and output stage 807. A control terminal (e.g., the gate) of the first transistor 802 is coupled to the first input terminal In of the output buffer 720_1. A first terminal (e.g., the source) of the first transistor 802 is coupled to the first current source 801. A control terminal (e.g., the gate) of the second transistor 803 is coupled to an output terminal Out of the output buffer 720_1. A first terminal (e.g., the source) of the second transistor 803 is coupled to the first current source 801. A control terminal (e.g., the gate) of the third transistor 805 is coupled to the first input terminal In of the output buffer 720_1. A first terminal (e.g., the source) of the third transistor 805 is coupled to the second current source 804. A control terminal (e.g., the gate) of the fourth transistor 806 is coupled to the second input terminal Ref of the output buffer 720_1. A first terminal (e.g., the source) of the fourth transistor 806 is coupled to the second current source 804**.

A first input terminal of a differential input pair of the gain and output stage 807 is coupled to a second terminal (e.g., the drain) of the first transistor 802 and a second terminal (e.g., the drain) of the third transistor 805. A second input terminal of said differential input pair is coupled to a second terminal (e.g., the drain) of the second transistor 803 and a second terminal (e.g., the drain) of the fourth transistor 806. An output terminal of the gain and output stage 807 is coupled to the output terminal Out of the output buffer 720_1. The gain and output stage 807 is well known by one skilled in the art, and thus related description is omitted herein.

Figure 9:
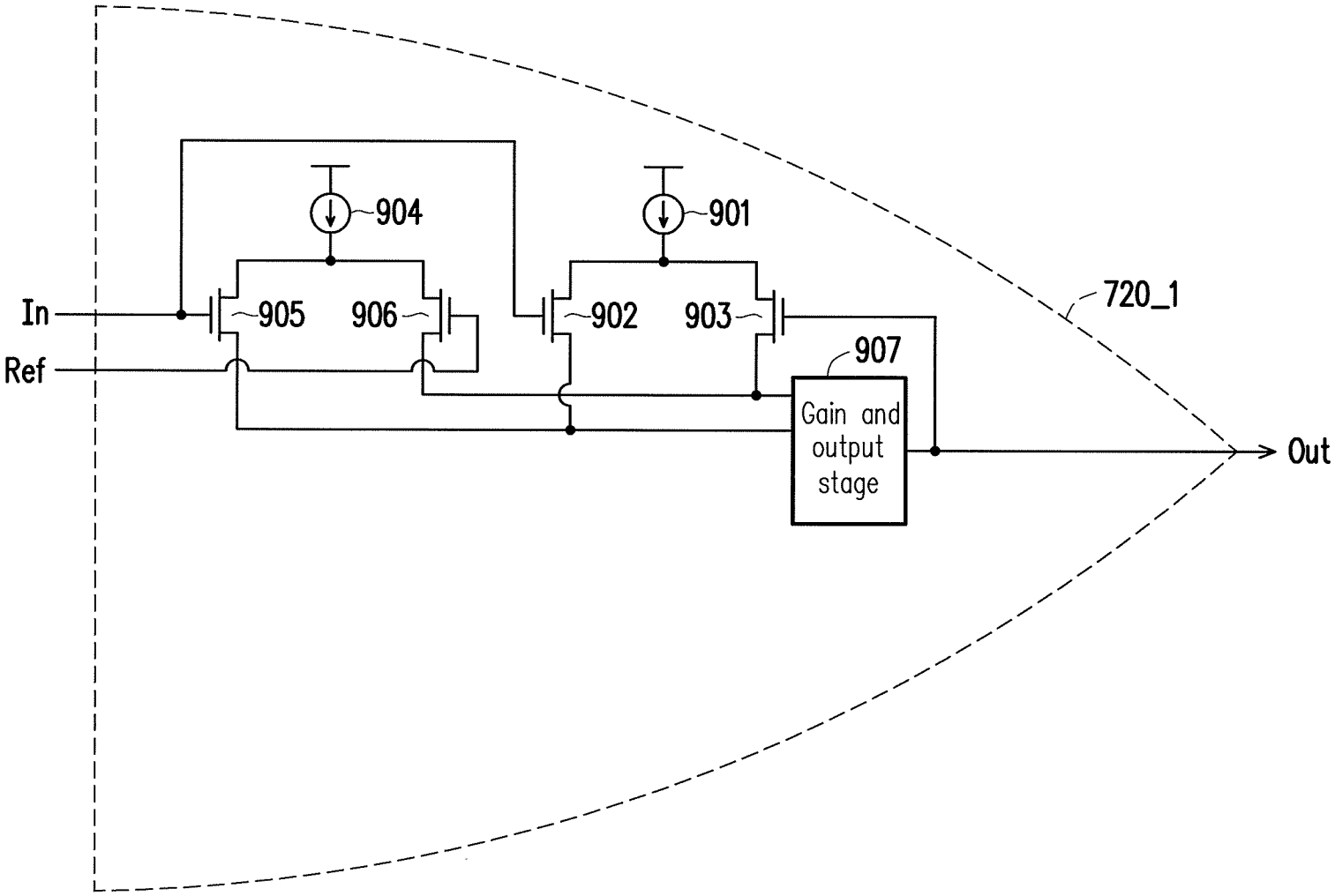
FIG. 9 is a block diagram illustrating circuitry of the output buffer depicted in FIG. 7 according to another embodiment of the invention.

FIG. 9 is a block diagram illustrating circuitry of the output buffer 720_1 depicted in FIG. 7 according to another embodiment of the invention. The other output buffers 720_2 to **720_*i* depicted in FIG. 7 may be deduced by reference with related description for the output buffer 720_1. Referring to FIG. 9, the output buffer 720_1 includes a first current source 901, a first transistor 902, a second transistor 903, a second current source 904, a third transistor 905, a fourth transistor 906 and a gain and output stage 907. A control terminal (e.g., the gate) of the first transistor 902 is coupled to the first input tensional In of the output buffer 720_1. A first terminal (e.g., the drain) of the first transistor 902 is coupled to the first current source 901. A control terminal (e.g., the gate) of the second transistor 903 is coupled to the output terminal Out of the output buffer 720_1. A first terminal (e.g., the drain) of the second transistor 903 is coupled to the first current source 901. A control terminal (e.g., the gate) of the third transistor 905 is coupled to the first input terminal In of the output buffer 720_1. A first terminal (e.g., the drain) of the third transistor 905 is coupled to the second current source 904. A control terminal (e.g., the gate) of the fourth transistor 906 is coupled to the second input terminal Ref of the output buffer 720_1. A first terminal (e.g., the drain) of the fourth transistor 906 is coupled to the second current source 904**.

A first input terminal of a differential input pair of the gain and output stage 907 is coupled to a second terminal (e.g., the source) of the first terminal 902 and a second terminal (e.g., the source) of the third transistor 905. A second input terminal of said differential input pair is coupled to a second terminal (e.g., the source) of the second transistor 903 and a second terminal (e.g., the source) of the fourth transistor 906. An output terminal of the gain and output stage 907 is coupled to the output terminal Out of the output buffer 720_1. The gain and output stage 907 is well known by one skilled in the art, and thus related description is omitted herein.

Figure 10:
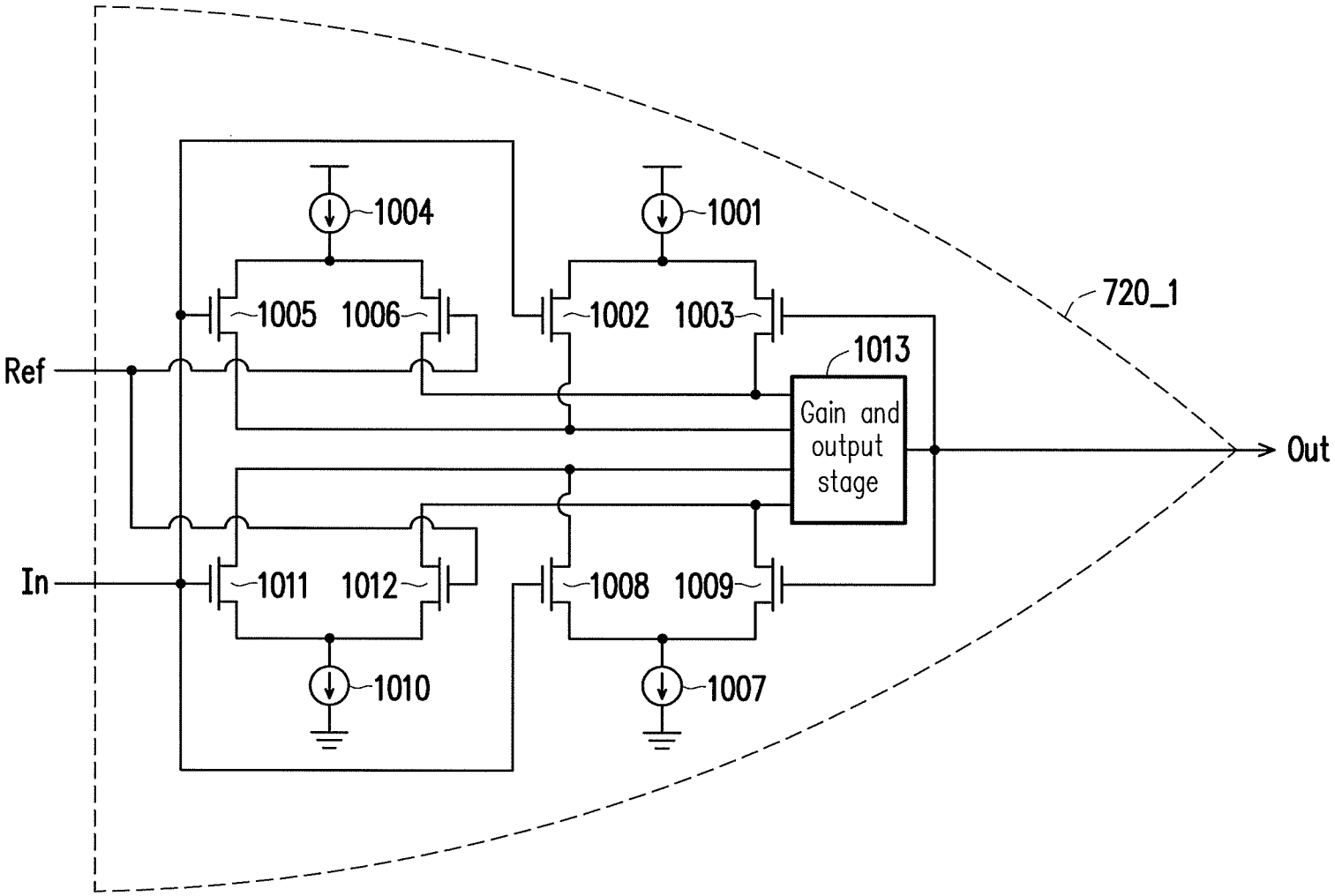
FIG. 10 is a block diagram illustrating circuitry of the output buffer depicted in FIG. 7 according to yet another embodiment of the invention.

FIG. 10 is a block diagram illustrating circuitry of the output buffer 720_1 depicted in FIG. 7 according to yet another embodiment of the invention. The other output buffers 720_2 to **720_*i* depicted in FIG. 7 may be deduced by reference with related description for the output buffer 720_1. Referring to FIG. 10, the output buffer 720_1 includes a first current source 1001, a first transistor 1002, a second transistor 1003, a second current source 1004, a third transistor 1005, a fourth transistor 1006, a third current source 1007 a fifth transistor 1008, a sixth transistor 1009, a fourth current source 1010, a seventh transistor 1011, an eighth transistor 1012 and a gain and output stage 1013. A control terminal (e.g., the gate) of the first transistor 1002 is coupled to the first input terminal In of the output buffer 720_1. A first terminal (e.g., the drain) of the first transistor 1002 is coupled to the first current source 1001. A control terminal (e.g., the gate) of the second transistor 1003 is coupled to the output terminal Out of the output buffer 720_1. A first terminal (e.g., the drain) of the second transistor 1003 is coupled to the first current source 1001. A control terminal (e.g., the gate) of the third transistor 1005 is coupled to the first input terminal In of the output buffer 720_1. A first terminal (e.g., the drain) of the third transistor 1005 is coupled to the second current source 1004. A control terminal (e.g., the gate) of the fourth transistor 1006 is coupled to the second input terminal Ref of the output buffer 720_1. A first terminal (e.g., the drain) of the fourth transistor 1006 is coupled to the second current source 1004**.

A control terminal (e.g., the gate) of the fifth transistor 1008 is coupled to the first input terminal In of the output buffer 720_1. A first terminal (e.g., the source) of the fifth transistor 1008 is coupled to the third current source 1007. A control terminal (e.g., the gate) of the sixth transistor 1009 is coupled to the output terminal Out of the output buffer 720_1. A first terminal (e.g., the source) of the sixth transistor 1009 is coupled to the third current source 1007. A control terminal (e.g., the gate) of the seventh transistor 1011 is coupled to the first input terminal In of the output buffer 720_1. A first terminal (e.g., the source) of the seventh transistor 1011 is coupled to the fourth current source 1010. A control terminal (e.g., the gate) of the eighth transistor 1012 is coupled to the second input terminal Ref of the output buffer 720_1. A first terminal (e.g., the source) of the eighth transistor 1012 is coupled to the fourth current source 1010.

A first input terminal of a first differential input pair of the gain and output stage 1013 is coupled to a second terminal (e.g., the source) of the first transistor 1002 and a second terminal (e.g., the source) of the third transistor 1005. A second input terminal of the first differential input pair of the gain and output stage 1013 is coupled to a second terminal (e.g., the source) of the second transistor 1003 and a second terminal (e.g., the source) of the fourth transistor 1006. A first input terminal of a second differential input pair of the gain and output stage 1013 is coupled to a second terminal (e.g., the drain) of the fifth transistor 1008 and a second terminal (e.g., the drain) of the seventh transistor 1011. A second input terminal of the second differential input pair of the gain and output stage 1013 is coupled to a second terminal (e.g., the drain) of the sixth transistor 1009 and a second terminal (e.g., the drain) of the eighth transistor 1012. An output terminal of the gain and output stage 1013 is coupled to the output terminal Out of the output buffer 720_1. The gain and output stage 1013 is well known by one skilled in the art, and thus related description is omitted herein.

Figure 11:
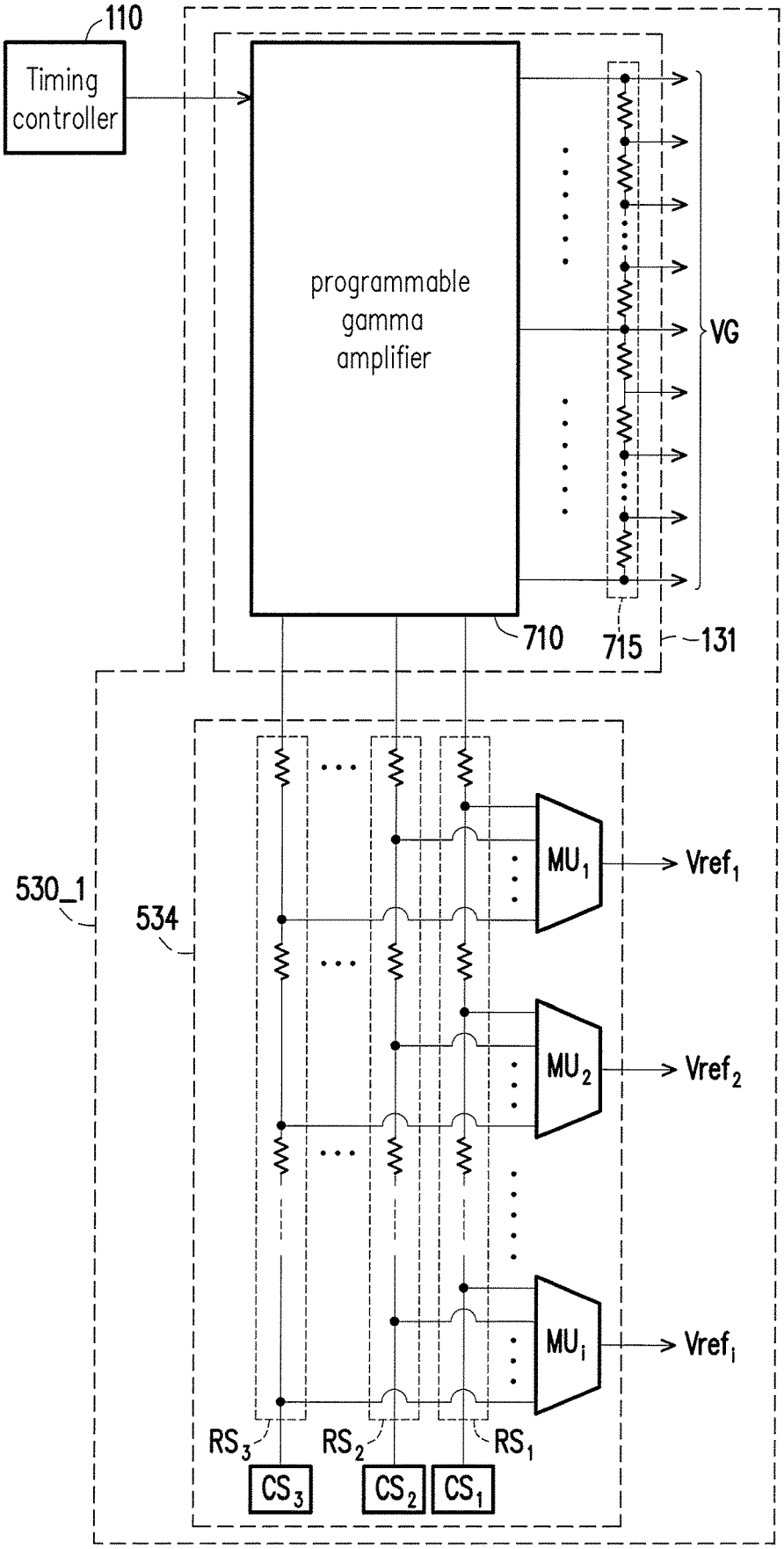
FIG. 11 is a block diagram illustrating circuitry of the source driver depicted in FIG. 5 according to another embodiment of the invention.

FIG. 11 is a block diagram illustrating circuitry of the source driver 530_1 depicted in FIG. 5 according to another embodiment of the invention. The other source drivers 530_2 to **530_*a* depicted in FIG. 5 may be deduced by reference with related description for the source driver 530_1. Referring to FIG. 11, the source driver 530_1 may include a programmable gamma generating circuit 131, a reference voltage generating unit 534 and a plurality of drive channel circuits 532_1, 532_2, . . . , 532_*i*. Herein, the drive channel circuits 532_1 to 532_*i* are not illustrated in FIG. 11 but may be deduced by reference with related descriptions for the drive channel circuits 532_1 to 532_*i* depicted in FIG. 7. The programmable gamma generating circuit 131 may provide a plurality of compensated gamma voltages VG. The programmable gamma generating circuit 131 includes a programmable gamma amplifier 710 and a gamma resistor string 715. The programmable gamma generating circuit 131, the programmable gamma amplifier 710, the gamma resistor string 715 and the compensated gamma voltages VG depicted in FIG. 11 may be deduced by reference with related descriptions for the programmable gamma generating circuit 131, the programmable gamma amplifier 710, the gamma resistor string 715 and the compensated gamma voltages VG depicted in FIG. 7. The compensated gamma voltages VG are outputted to all the drive channel circuits of the source driver 530_1 (not illustrated in FIG. 11, but may be deduced by reference with related descriptions for the drive channel circuits 532_1 to 532_*i* depicted in FIG. 7**).

Each of the drive channel circuits 532_1 to **532_*i* (not illustrated in FIG. 11, but may be deduced by reference with related descriptions for the drive channel circuits 532_1 to 532_*i* depicted in FIG. 7) includes a DAC and an output buffer. The drive channel circuits 532_1 to 532_*i*, the digital-to-analog converters 410_1 to 410_*i* and the output buffers 720_1 to 720_*i* depicted in FIG. 11 may be deduced by reference with related descriptions for the drive channel circuits 532_1 to 532_*i*, the digital-to-analog converters 410_1 to 410_*i* and the output buffers 720_1 to 720_*i* depicted in FIG. 7**, which are not repeated hereinafter.

Referring to FIG. 11, the reference voltage generating unit 534 includes a plurality of resistor strings $RS_1$, $RS_2$, . . . , $RS_3$, a plurality of programmable current sources $CS_1$, $CS_2$, . . . , $CS_3$ and a plurality of selection circuits $MU_1$, $MU_2$, . . . , $MU_i$. First terminals of the resistor strings $RS_1$ to $RS_3$ respectively receive different reference voltages provided by the programmable gamma amplifier 710 of the programmable gamma generating circuit 131 in one-to-one manner. The reference voltages provided to the resistor strings $RS_1$ to $RS_3$ may be the same as some of those rough gamma voltages provided to the gamma resistor string 715, or may be generated based on some of those rough gamma voltages. Second terminals of the resistor strings $RS_1$ to $RS_3$ are respectively coupled to the programmable current sources $CS_1$ to $CS_3$ in one-to-one manner. The programmable current sources $CS_1$ to $CS_3$ may provide source current or sink current to the resistor strings $RS_1$ to $RS_3$. Therefore, the programmable current sources $CS_1$ to $CS_3$ are capable of adjusting voltages of the voltage dividing nodes of the resistor strings $RS_1$ to $RS_3$. Input terminals of the selection circuits $MU_1$ to $MU_i$ are respectively coupled to the difference voltage dividing nodes of the resistor strings $RS_1$ to $RS_3$ in one-to-one manner, as shown by FIG. 11. The selection circuits $MU_1$ to $MU_i$ may selectively connect the voltage dividing nodes of the resistor strings $RS_1$ to $RS_3$ respectively to the second input terminals Ref of the output buffers in one-to-one manner (not illustrated in FIG. 11, but may be deduced by reference with related descriptions for the second input terminals Ref of the output buffers 720_1 to **720_*i* depicted in FIG. 7). Based on current control of the programmable current sources CS; to $CS_3$, and/or voltage selection of the selection circuits $MU_1$ to $MU_i$, the reference voltage generating unit 534 may provide the corresponding reference voltages $Vref_1$ to $Vref_i$ to the output buffers according to design requirements. In other words, the reference voltage generating unit 534 may adjust the fine compensation voltages VC'(1) to VC'(i) of the compensated source driving voltages of the source lines SL(1**) to SL(i) according to design requirements.

Figure 12:
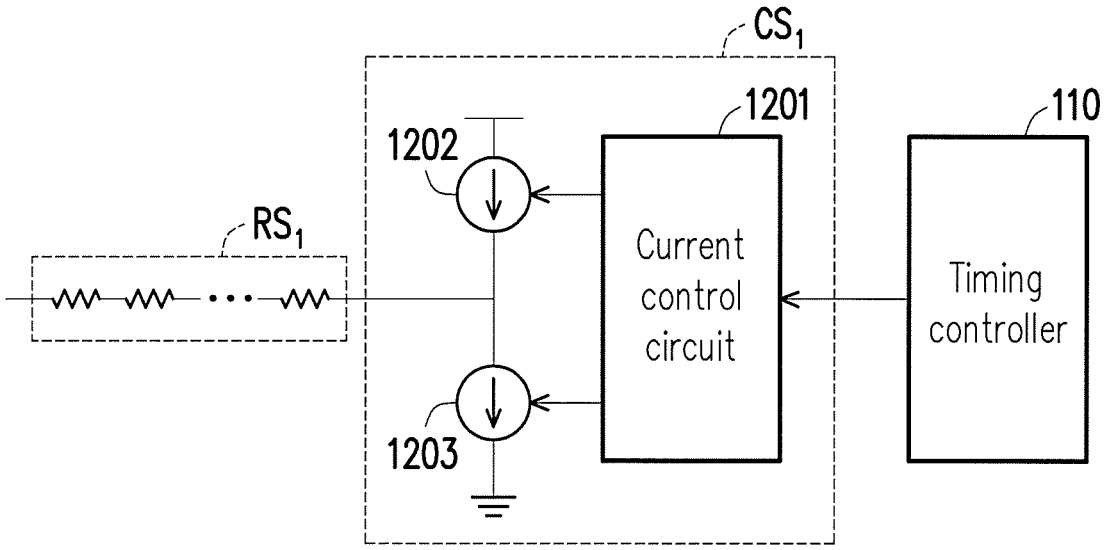
FIG. 12 is a block diagram illustrating circuitry of the programmable current source depicted in FIG. 11 according to an embodiment of the invention.

FIG. 12 is a block diagram illustrating circuitry of the programmable current source $CS_1$ depicted in FIG. 11 according to an embodiment of the invention. The other programmable current sources $CS_2$ to $CS_3$ may be deduced by reference with related description for the programmable current source $CS_1$. Referring to FIG. 12, the programmable current source $CS_1$ includes a current control circuit 1201, a first current source 1202 and a second current source 1203. Under control of the timing controller 110, the current control circuit 1201 may output a first control signal and a second control signal to the first current source 1202 and the second current source 1203, respectively. A current output terminal of the first current source 1202 is coupled to a second terminal of one corresponding resistor string $RS_1$ among the resistor strings $RS_1$ to $RS_3$. A current input terminal of the second current source 1203 is coupled to the second terminal of the corresponding resistor string $RS_1$. The current control circuit 1201 determines whether the first current source 1202 provides current (i.e., source current) to the second terminal of the corresponding resistor string $RS_1$ according to the first control signal, and also determines whether the second current source 1202 drains current (i.e., sink current) from the second terminal of the resistor string $RS_1$ according to the second control signal.

Figure 13:
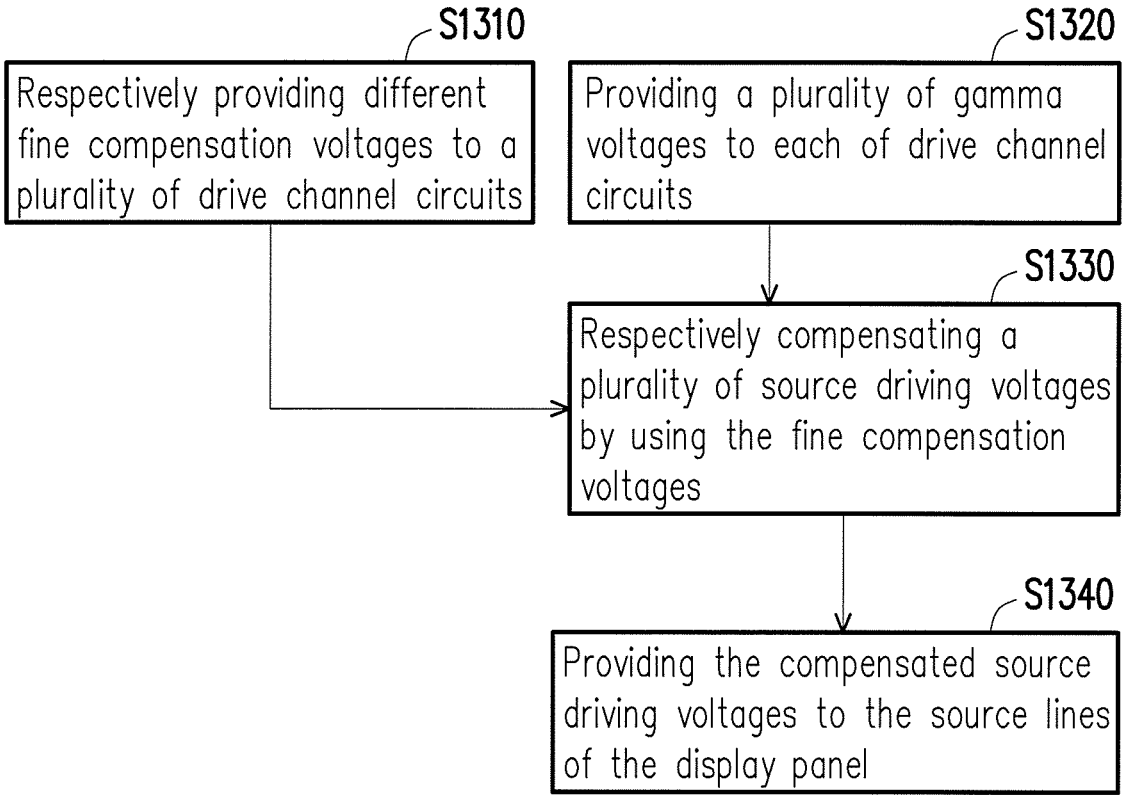
FIG. 13 is a flowchart illustrating an operating method of a source driver according to an embodiment of the invention.

It should be noted that in another embodiment, for a display apparatus comprising multiple source drivers, the drive channel circuits of each source driver uses fine compensation voltages and the programmable gamma generating circuit of each source driver does not use a coarse compensation voltage so that a plurality of original (uncompensated) gamma voltages is provided to the ADCs of the drive channel circuits. FIG. 13 is a flowchart illustrating an operating method of a source driver according to an embodiment of the invention. In step S1310, a reference voltage generating unit of the source driver respectively provides different fine compensation voltages to a plurality of drive channel circuits of the source driver. In step S1320, a programmable gamma generating circuit of the source driver provides a plurality of gamma voltages (which are uncompensated gamma voltages) to each of drive channel circuits of the source driver. In step S1330, the drive channel circuits use the fine compensation voltages to respectively compensate a plurality of source driving voltages (which are selected from the plurality of gamma voltages by the drive channel circuits) to obtain a plurality of compensated source driving voltages. In step S1340, the drive channel circuits provide the compensated source driving voltages to the source lines of the display panel in one-to-one manner.

In summary, according to the display apparatus, the source driver of the display apparatus and the operating method of the display apparatus as described in the embodiments of the invention, the different compensation voltages may be used to respectively compensate the source driving voltages of the different source lines of the display panel. The compensated source driving voltages may solve the problem of display errors caused by the different gate falling edge slopes for the pixel units.

Although the present disclosure has been described with reference to the above embodiments, it will be apparent to one of ordinary skill in the art that modifications to the described embodiments may be made without departing from the spirit of the disclosure. Accordingly, the scope of the disclosure will be defined by the attached claims and not by the above detailed descriptions.

What is claimed is:

1. A display apparatus, comprising:

a display panel, comprising a plurality of source lines and a plurality of gate lines, wherein each of the source lines is perpendicular to each of the gate lines;

at least one gate driver having a plurality of output terminals coupled to the gate lines; and a plurality of source drivers having a plurality of output terminals coupled to the source lines to provide a plurality of source driving voltages to the source lines, wherein the plurality of source driving voltages include first coarse compensation voltages assigned by a first source driver of the plurality of source drivers, and the source driving voltages include second coarse compensation voltages assigned by a second source driver of the plurality of source drivers, wherein each of the first coarse compensation voltages assigned by the first source driver has the same first voltage value, each of the second coarse compensation voltages assigned by the second source driver has the same second voltage value, and the first coarse compensation voltages assigned by the first source driver are different from the second coarse compensation voltages assigned by the second source driver, wherein the first coarse compensation voltages are respectively configured based on distances between the first source driver and input terminals of the gate lines so as to compensate for feed-through voltages induced by parasitic capacitances between the source lines controlled by the first source driver and the gate lines, wherein the second coarse compensation voltages are respectively configured based on distances between the second source driver and input terminals of the gate lines so as to compensate for feed-through voltages induced by parasitic capacitances between the source lines controlled by the second source driver and the gate lines.

2. The display apparatus according to claim 1, wherein one of the source drivers comprises:

a programmable gamma generating circuit, configured to use one corresponding coarse compensation voltage among the coarse compensation voltages to respectively compensate original gamma voltages so as to provide a plurality of compensated gamma voltages; and a plurality of drive channel circuits, coupled to the programmable gamma generating circuit to receive the compensated gamma voltages, wherein each of the drive channel circuits comprises a digital-to-analog converter and an output buffer, the digital-to-analog converter converts digital pixel data into a source driving voltage according to the compensated gamma voltages, a first input terminal of the output buffer is coupled to an output terminal of the digital-to-analog converter to receive the source driving voltage, and the output buffer is configured to output the source driving voltage to one corresponding source line among the source lines.

3. The display apparatus of claim 1, further comprising:

a timing controller, coupled to the source drivers and the gate driver, wherein the timing controller provides different voltage setting instructions respectively to a plurality of programmable gamma generating circuits of the source drivers to set a plurality of compensated gamma voltages for each source driver, wherein the voltage setting instructions respectively determine the coarse compensation voltages.

4. The display apparatus according to claim 1, wherein the first source driver of the plurality of source drivers comprises:

a programmable gamma generating circuit, configured to use one corresponding coarse compensation voltage among the coarse compensation voltages to respectively compensate original gamma voltages so as to provide a plurality of compensated gamma voltages; and a plurality of drive channel circuits, coupled to the programmable gamma generating circuit to receive the compensated gamma voltages and a plurality of fine compensation voltages, wherein a plurality of output terminals of the drive channel circuits are coupled to the source lines with respect to the first source driver to provide a plurality of compensated source driving voltages with respect to the first source driver, the compensated source driving voltages with respect to the first source driver are configured to include different fine compensation voltages which are respectively provided to the plurality of drive channel circuits, and wherein the fine compensation voltages are respectively configured based on distances between the source lines with respect to the first source driver and the input terminal of the gate lines.

5. The display apparatus according to claim 4, wherein each of the drive channel circuits comprises:

a digital-to-analog converter, coupled to the programmable gamma generating circuit to receive the compensated gamma voltages, wherein the digital-to-analog converter converts digital pixel data into a source driving voltage according to the compensated gamma voltages; and an output buffer having a first input terminal coupled to an output terminal of the digital-to-analog converter to receive the source driving voltage, and a second input terminal coupled to a reference voltage generating unit to receive one corresponding reference voltage among a plurality of reference voltages, and an output terminal outputting one of the compensated source driving voltages to one corresponding source line among the source lines with respect to the first source driver, wherein the plurality of reference voltages are the fine compensation voltages and the corresponding compensated source driving voltage outputted by the output buffer is the source driving voltage outputted by the digital-to-analog converter plus one corresponding fine compensation voltage among the fine compensation voltages.

6. The display apparatus according to claim 5, wherein the output buffer comprises:

a first current source;

a first transistor having a control terminal coupled to the first input terminal of the output buffer, and a first terminal coupled to the first current source;

a second transistor having a control terminal coupled to the output terminal of the output buffer, and a first terminal coupled to the first current source;

a second current source;

a third transistor having a control terminal coupled to the first input terminal of the output buffer, and a first terminal coupled to the second current source;

a fourth transistor having a control terminal coupled to the second input terminal of the output buffer, and a first terminal coupled to the second current source; and a gain and output stage having a first differential input pair and an output terminal, wherein a first input terminal of the first differential input pair is coupled to a second terminal of the first transistor and a second terminal of the third transistor, a second input terminal of the first differential input pair is coupled to a second terminal of the second transistor and a second terminal of the fourth transistor, and the output terminal of the gain and output stage is coupled to the output terminal of the output buffer.

7. The display apparatus according to claim 6, wherein the output buffer further comprises:

a third current source;

a fifth transistor having a control terminal coupled to the first input terminal of the output buffer, and a first terminal coupled to the third current source;

a sixth transistor having a control terminal coupled to the output terminal of the output buffer, and a first terminal coupled to the third current source;

a fourth current source;

a seventh transistor having a control terminal coupled to the first input terminal of the output buffer, and a first terminal coupled to the fourth current source; and an eighth transistor having a control terminal coupled to the second input terminal of the output buffer, and a first terminal coupled to the fourth current source, wherein the gain and output stage further has a second differential input pair, a first input terminal of the second differential input pair is coupled to a second terminal of the fifth transistor and a second terminal of the seventh transistor, and a second input terminal of the second differential input pair is coupled to a second terminal of the sixth transistor and a second terminal of the eighth transistor.

8. The display apparatus according to claim 5, wherein the reference voltage generating unit comprises:

a resistor string having a first tell iinal and a plurality of voltage dividing nodes, wherein the first terminal of the resistor string receives a rough gamma voltage provided by the programmable gamma generating circuit, and the voltage dividing nodes are respectively coupled to the second input terminals of the output buffers of the drive channel circuits.

9. The display apparatus according to claim 5, wherein the reference voltage generating unit comprises:

a plurality of resistor strings having a plurality of first terminals respectively receiving a plurality of rough gamma voltages provided by the programmable gamma generating circuit; and a plurality of selection circuits having output terminals respectively coupled to the second input terminals of the output buffers of the drive channel circuits, wherein the selection circuits are configured to selectively connect a plurality of voltage dividing nodes of the resistor strings respectively to the second input terminals of the output buffers.

10. The display apparatus according to claim 9, wherein the reference voltage generating unit further comprises:

a plurality of programmable current sources, respectively coupled to a plurality of second terminals of the resistor strings, wherein the programmable current sources are configured to provide current to the second terminals of the resistor strings or drain current from the second terminals of the resistor strings.

11. The display apparatus according to claim 10, wherein one of the programmable current sources comprises:

a first current source having a current output terminal coupled to the second terminal of one corresponding resistor string among the resistor strings, wherein the first current source determines whether to provide current to the second terminal of the corresponding resistor string according to a first control signal; and a second current source having a current input terminal coupled to the second terminal of the corresponding resistor string, wherein the second current source determines whether to drain current from the second terminal of the corresponding resistor string according to a second control signal.

12. A source driver, configured to drive a plurality of source lines of a display panel, and comprising:

a programmable gamma generating circuit, configured to provide a plurality of gamma voltages; and a plurality of drive channel circuits, coupled to the programmable gamma generating circuit to receive the gamma voltages, wherein a plurality of output terminals of the drive channel circuits are coupled to the source lines to provide a plurality of compensated source driving voltages to the source lines, and the plurality of compensated source driving voltages include multiple coarse compensation voltages and multiple fine compensation voltages, wherein each of the coarse compensation voltages provided from different drive channel circuits has the same voltage value, and each of the fine compensation voltages provided from different drive channel circuits has a different voltage value, wherein the fine compensation voltages are respectively configured based on distances between input terminals of a plurality of gate lines of the display panel and the source lines connecting to the source driver so as to compensate for feed-through voltages induced by parasitic capacitances between the source lines and the gate lines, wherein each of the source lines is perpendicular to each of the gate lines.

13. The source driver according to claim 12, wherein the programmable gamma generating circuit is configured to use the coarse compensation voltages to respectively compensate original gamma voltages in such a way that each of the plurality of gamma voltages outputted by the programmable gamma generating circuit is a corresponding original gamma voltage plus one of the coarse compensation voltages.

14. The source driver according to claim 12, wherein the source driver further comprises a reference voltage generating unit, and each of the drive channel circuits comprises:

a digital-to-analog converter, coupled to the programmable gamma generating circuit to receive the gamma voltages, wherein the digital-to-analog converter converts digital pixel data into a source driving voltage according to the gamma voltages; and an output buffer having a first input terminal, a second input terminal and an output terminal, wherein the first input terminal of the output buffer is coupled to an output terminal of the digital-to-analog converter to receive the source driving voltage, the second input terminal of the output buffer is coupled to the reference voltage generating unit to receive one corresponding reference voltage among a plurality of reference voltages, and the output terminal of the output buffer outputs one of a plurality of compensated source driving voltages to one corresponding source line among the source lines, wherein the plurality of reference voltages are a plurality of fine compensation voltages and the compensated source driving voltage outputted by the output buffer is the source driving voltage outputted by the digital-to-analog converter plus one corresponding fine compensation voltage among the fine compensation voltages.

15. The source driver according to claim 14, wherein the output buffer comprises:

a first current source;

a first transistor having a control terminal coupled to the first input terminal of the output buffer, and a first terminal coupled to the first current source;

a second transistor having a control terminal coupled to the output terminal of the output buffer, and a first terminal coupled to the first current source;

a second current source;

a third transistor having a control terminal coupled to the first input terminal of the output buffer, and a first terminal coupled to the second current source;

a fourth transistor having a control terminal coupled to the second input terminal of the output buffer, and a first terminal coupled to the second current source; and a gain and output stage having a first differential input pair and an output terminal, wherein the a first input terminal of the first differential input pair is coupled to a second terminal of the first transistor and a second terminal of the third transistor, a second input terminal of the first differential input pair is coupled to a second terminal of the second transistor and a second terminal of the fourth transistor, and the output terminal of the gain and output stage coupled to the output terminal of the output buffer.

16. The source driver according to claim 15, wherein the output buffer further comprises:

a third current source;

a fifth transistor having a control terminal coupled to the first input terminal of the output buffer, and a first terminal coupled to the third current source;

a sixth transistor having a control terminal coupled to the output terminal of the output buffer, and a first terminal coupled to the third current source;

a fourth current source;

a seventh transistor having a control terminal coupled to the first input terminal of the output buffer, and a first terminal coupled to the fourth current source; and an eighth transistor having a control terminal coupled to the second input terminal of the output buffer, and a first terminal coupled to the fourth current source, wherein the gain and output stage further has a second differential input pair, wherein a first input terminal of the second differential input pair is coupled to a second terminal of the fifth transistor and a second terminal of the seventh transistor, and a second input terminal of the second differential input pair is coupled to a second terminal of the sixth transistor and a second terminal of the eighth transistor.

17. The source driver according to claim 14, wherein the reference voltage generating unit comprises:

a resistor string having a first terminal and a plurality of voltage dividing nodes, wherein the first terminal of the resistor string receives a rough gamma voltage provided by the programmable gamma generating circuit, and the voltage dividing nodes respectively coupled to the second input terminals of the output buffers of the drive channel circuits.

18. The source driver according to claim 14, wherein the reference voltage generating unit comprises:

a plurality of resistor strings having a plurality of first terminals respectively receiving a plurality of rough gamma voltages provided by the programmable gamma generating circuit; and a plurality of selection circuits having output terminals respectively coupled to the second input terminals of the output buffers of the drive channel circuits, wherein the selection circuits are configured to selectively connect a plurality of voltage dividing nodes of the resistor strings respectively to the second input terminals of the output buffers.

19. The source driver according to claim 18, wherein the reference voltage generating unit further comprises:

a plurality of programmable current sources, respectively coupled to a plurality of second terminals of the resistor strings, wherein the programmable current sources are configured to provide current to the second terminals of the resistor strings or drain current from the second terminals of the resistor strings.

20. The source driver according to claim 19, wherein one of the programmable current sources comprises:

a first current source having a current output terminal coupled to the second terminal of one corresponding resistor string among the resistor strings, wherein the first current source determines whether to provide current to the second terminal of the corresponding resistor string according to a first control signal; and a second current source having a current input terminal coupled to the second terminal of the corresponding resistor string, wherein the second current source determines whether to drain current from the second terminal of the corresponding resistor string according to a second control signal.

21. An operating method of a source driver, wherein the source driver is configured to drive a plurality of source lines of a display panel, the display panel includes a plurality of gate lines respectively perpendicular to each of the source lines, and the operation method comprises:

providing a plurality of gamma voltages to a plurality of drive channel circuits of the source driver;

respectively providing multiple coarse compensation voltages and multiple fine compensation voltages to the plurality of drive channel circuits, wherein each of the coarse compensation voltages provided from different drive channel circuits has the same voltage value, and each of the fine compensation voltages provided from different drive channel circuits has a different voltage value, wherein the fine compensation voltages are respectively configured based on distances between input terminals of the gate lines and the source lines connecting to the source driver so as to compensate for feed-through voltages induced by parasitic capacitances between the source lines and the gate lines;

respectively, through the drive channel circuits, compensating a plurality of source driving voltages by using the coarse compensation voltages and the fine compensation voltages to obtain a plurality of compensated source driving voltages; and providing the plurality of compensated source driving voltages to the source lines by the drive channel circuits.

22. The operating method according to claim 21, further comprising:

using the coarse compensation voltages to respectively compensate a plurality of original gamma voltages to generate the plurality of gamma voltages, in such a way that each of the gamma voltages is a corresponding original gamma voltage plus one of the coarse compensation voltages.

* * * * *